US009008561B2

(12) United States Patent
Maeda

(10) Patent No.: US 9,008,561 B2
(45) Date of Patent: Apr. 14, 2015

(54) FIXING DEVICE

(71) Applicant: Masataka Maeda, Kohnan (JP)

(72) Inventor: Masataka Maeda, Kohnan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 87 days.

(21) Appl. No.: 13/851,420

(22) Filed: Mar. 27, 2013

(65) Prior Publication Data

US 2013/0279955 A1 Oct. 24, 2013

(30) Foreign Application Priority Data

Mar. 27, 2012 (JP) ..... 2012-071012
Mar. 27, 2012 (JP) ..... 2012-071014
Mar. 27, 2012 (JP) ..... 2012-071015

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2053; G03G 15/2064; G03G 2215/2016; G03G 2215/2022; G03G 2215/2035
USPC ..... 399/329, 328
See application file for complete search history.

(56) References Cited

U.S. PATENT DOCUMENTS

| | | | | |
|---|---|---|---|---|
| 2009/0208264 | A1* | 8/2009 | Fujiwara et al. | 399/329 |
| 2011/0026988 | A1* | 2/2011 | Yoshikawa et al. | 399/329 |
| 2011/0150543 | A1 | 6/2011 | Fujiwara et al. | |
| 2011/0164905 | A1 | 7/2011 | Kondo et al. | |
| 2011/0217096 | A1* | 9/2011 | Kikuchi et al. | 399/329 |
| 2011/0236088 | A1 | 9/2011 | Maruyama | |
| 2013/0195527 | A1* | 8/2013 | Suzuki et al. | 399/329 |

FOREIGN PATENT DOCUMENTS

| | | | |
|---|---|---|---|
| JP | 07-152271 | A | 6/1995 |
| JP | 2008-257946 | A | 10/2008 |
| JP | 2011-095540 | A | 5/2011 |
| JP | 2011-095549 | A | 5/2011 |
| JP | 2011-203405 | A | 10/2011 |

* cited by examiner

*Primary Examiner* — Sophia S Chen
(74) *Attorney, Agent, or Firm* — Banner & Witcoff, Ltd.

(57) ABSTRACT

A fixing device may include an endless fixing belt, a facing member facing an outer surface of the fixing belt, a nip member configured to contact an inner surface of the fixing belt to form a nip portion where the fixing belt and the facing member are in contact with each other, and a heat source device configured to heat the nip portion inside the fixing belt. The nip member includes a heat transfer member which is provided at a position corresponding to a portion of the nip portion when seen from a side view, and a heat insulating member which is a portion of the nip member except for the heat transfer member, and is made of a material having thermal conductivity lower than that of the heat transfer member.

20 Claims, 27 Drawing Sheets

FIXING DEVICE

CROSS-REFERENCE TO RELATED APPLICATION

This application claims priority from Japanese Patent Application Nos. 2012-071012, 2012-071014, 2012-071015, all filed on Mar. 27, 2012, the entire subject matters of which are incorporated herein by reference.

TECHNICAL FIELD

Aspects of the present invention relate to a fixing device configured to thermally fix an image formed by developer adhered to a sheet-like recording medium.

BACKGROUND

There is known a fixing device employing, as a hearting side member, an endless fixing belt having a heater in order to reduce an electric power and shorten a warm-up time (for example, JP-A-2008-257946, JP-A-2011-95540, JP-A-2011-95549, and JP-A-2011-203405).

SUMMARY

In the above-described fixing device, by causing heat generated by the heater to be effectively transferred to a fixing area (area for hating and pressing a recording medium with developer electrostatically adhered thereto so as to fix the developer to the recording medium by softening or melting the developer), an electric power can be further reduced or a warm-up time can be further shortened.

According to an aspect of the present invention, there may be provided a fixing device including a fixing belt, a facing member, a nip member and a heat source device. The fixing belt is an endless belt. The facing member is provided to face an outer surface of the fixing belt. The nip member is configured to contact an inner surface of the fixing belt to form a nip portion where the fixing belt and the facing member are in contact with each other. The heat source device is configured to heat the nip portion inside the fixing belt. The nip member includes a heat transfer member and a heat insulating member. The heat transfer member is provided at a position corresponding to a portion of the nip portion when seen from a side view to transfer heat from the heat source device to the nip portion. The heat insulating member is a portion of the nip member except for the heat transfer member, and is made of a material having thermal conductivity lower than that of the heat transfer member.

According to the above configuration, the heat generated from the heat source device is received by the heat transfer member. The heat received by the heat transfer member is radiated to the nip portion. Therefore, the nip portion is heated.

The heat transfer member is provided at the position corresponding to a portion of the nip portion when seen from a side view (i.e., a portion of the nip portion in the transport direction). Therefore, the heating portion (the portion receives the heat generated from the heat source device) of the nip portion is not provided over the whole nip portion, but is concentrated at a relatively narrow area thereof. Accordingly, while the developer carried on a recording medium is intensively heated, the heat transfer to the recording medium may be suppressed as possible. Therefore, it may be possible to obtain good fixing strength and fixing efficiency, thereby reducing an electric power and a warm-up time.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Illustrative embodiments of the present invention will be described with reference to the accompanying drawings. The following description is nothing more than the specific description of illustrative embodiments of the present invention in order to fulfill requirements of the specification. Thus, as will be described later, naturally, the present invention is not limited to the specific configurations of illustrative embodiments described below. Modifications that can be made to illustrative embodiments are collectively described at the end.

<Overall Configuration of Laser Printer>

Figure 1:
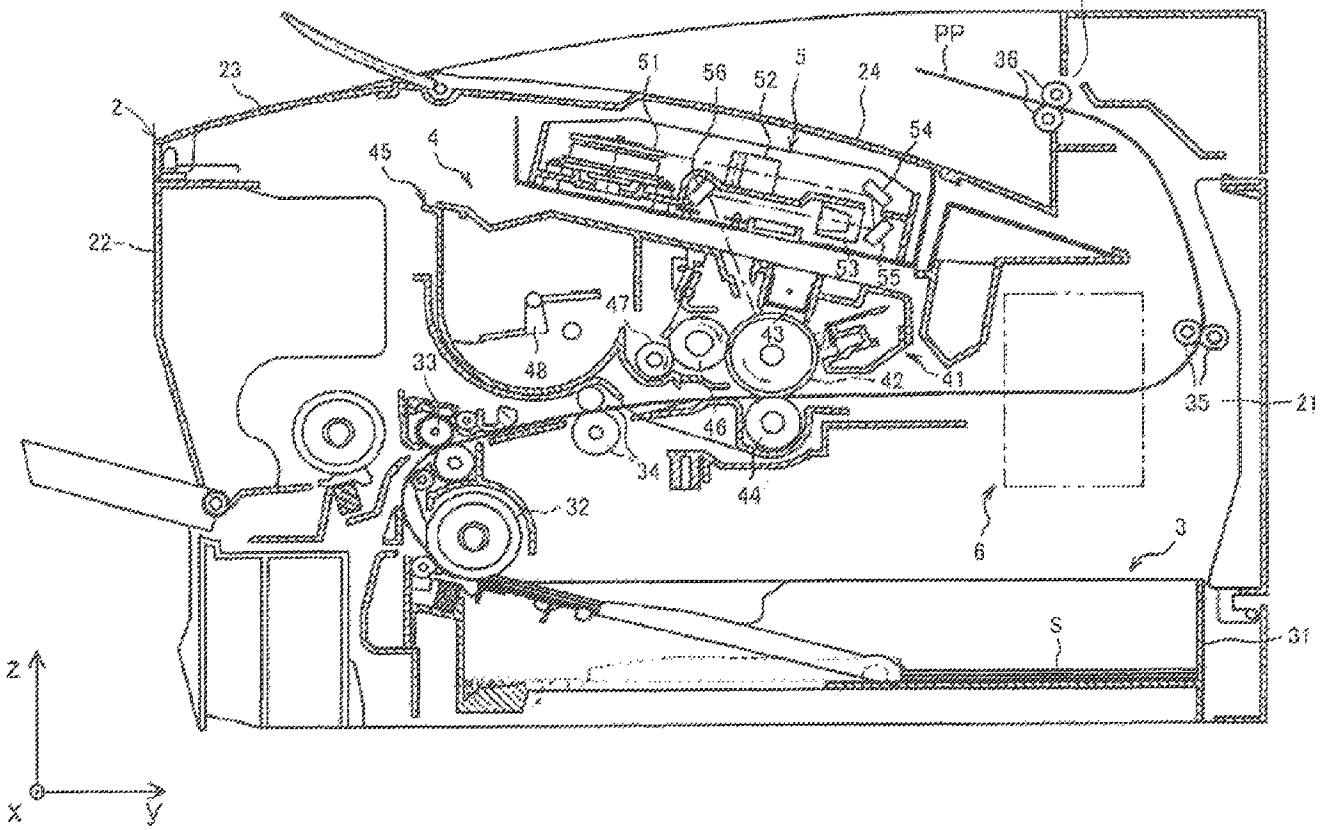
FIG. 1 is a side view schematically illustrating the configuration of a laser printer which is an image forming apparatus according to an illustrative embodiment of the present invention.

FIG. 1 is a side view schematically illustrating the configuration of a laser printer 1 which is an image forming apparatus according to an illustrative embodiment of the present invention. The laser printer 1 is configured to form an image (hereinafter, referred to as a toner image) by a non-magnetic single-component developer (toner) on a sheet S which is a sheet-like recording medium while transporting the sheet S along a sheet transport path PP (sheet path) inside the printer.

In the following description, a direction (i.e., a tangential direction at an arbitrary position of the sheet transport path PP) in which the sheet S is transported along the sheet transport path PP in FIG. 1 is referred to as "a sheet transport direction". Additionally, the right side (positive direction of y-axis) in the drawing is referred to as the "rear side", and the left side (negative direction of y-axis) in the drawing is referred to as the "front side". Hence, the left-right direction in FIG. 1 corresponds to a front-rear direction of the laser printer 1. The width direction of the laser printer 1 which is a direction perpendicular to the left-right direction (above-described front-rear direction) and the upper-lower direction (height direction of the laser printer 1 (direction of z-axis in the drawing)) in FIG. 1 is referred to as "sheet width direction". This sheet width direction (direction of x-axis in the drawing) is a direction perpendicular to the sheet transport direction and the thickness direction of the sheet S.

The laser printer 1 includes a main body 2, a sheet transport unit 3, a process cartridge 4, a scanner unit 5, and a fixing unit 6.

The main body 2 has a body frame 21 for supporting the sheet transport unit 3, the process cartridge 4, the scanner unit 5, and the fixing unit 6. The body frame 21 is covered by an outer cover 22. The outer cover 21 is a box-like member made of synthetic resin to configure a casing of the laser printer 1.

A top cover 23 configuring an upper plate of the outer cover 22 is provided with a concave portion which is further deepened as proceeding to the rear side. A sheet discharge tray 24 is defined by a bottom surface of the concave portion. That is, the sheet discharge tray 24 has an inclined surface directing obliquely downward to the rear side from a front side of the top cover 23 so as to receive the sheet S with an image formed thereon discharged from a sheet discharge port 25 and load plural sheets thereon. The sheet discharge port 25 is an opening provided on an upper side of a lower end portion (rear end portion) of the sheet discharge tray 24 in the outer cover 22, and is formed in a slit type having a longitudinal direction in the sheet width direction.

The sheet transport unit 3 includes a sheet cassette 31, a sheet feed roller 32, a pair of sheet powder removal rollers 33, a pair of registration rollers 34, a transport roller 35, and a pair of sheet discharge rollers 36. The sheet transport unit 3 is configured to transport the sheet S from the sheet cassette 31 to the sheet discharge tray 24 along the sheet transport path PP.

The sheet cassette 31 is provided below the main body 2. The sheet cassette 31 is configured to slide in the front-rear direction, and is detachably mounted (that is, easily attached to and detached from) on the body frame 21. Plural sheets P are received in a stacked state within the sheet cassette 31.

The sheet feed roller 32 is rotatably supported in a bottom portion of the main body 2, and is disposed to contact a leading end of the uppermost one of the sheet S received in the sheet cassette 31 in the stacked state. The sheet feed roller 32 is configured to rotate to pick up the sheet S from the sheet cassette 31 one by one, and transport it to the pair of sheet powder removal rollers 33.

The pair of sheet powder removal rollers 33 is provided at a downstream side from the sheet feed roller 32 in the sheet transport direction, and sends the sheet S to the pair of registration rollers 34 while removing sheet powder from the sheet S which is picked up by the sheet feed roller 32. The pair of registration rollers 34 is disposed at a position corresponding to a bottom portion of the process cartridge 4 at an upstream side from a transfer position, which will be described later, in the sheet transport direction. The pair of registration rollers 34 is provided to supply the sheet S to the transfer position while adjusting an inclination of the sheet S and a transport timing.

The transport roller 35 is disposed at the downstream side than the fixing unit 6 in the sheet transport direction to send the sheet S passed the fixing unit 6 to the sheet discharge port 25. The pair of sheet discharge rollers 36 is provided near the sheet discharge port 25 to discharge the sheet S, on which the toner image is formed and fixed while passing the process cartridge 4 and the fixing unit 6, onto the sheet discharge tray 24.

The process cartridge 4 is detachably stored in the main body 2. That is, the process cartridge 4 is configured to be easily attached to or detached from the main body 2 for its replacement or the maintenance inside the laser printer 1. Specifically, a process case 41 which is a portion of the casing of the process cartridge 4 is configured to be attached to or detached from the body frame 21. A photosensitive drum 42, a charging unit 43, a transfer roller 44, and a toner case 45 are mounted on the process case 41.

The photosensitive drum 42 is a cylindrical member having a photosensitive layer formed around its outer circumference. The photosensitive drum 42 is rotatably supported by the process case 41. That is, as the photosensitive drum 42 is rotated around an axis parallel with the sheet width direction, its circumference, that is, an electrostatic latent image carrying surface, is moved in a direction perpendicular to the sheet width direction. The charging unit 43 is disposed to face the electrostatic latent image carrying surface to uniformly charge the electrostatic latent image carrying surface.

The transfer roller 44 is provided to face the electrostatic latent image carrying surface, with the sheet transport path PP being interposed therebetween at the transfer position. The transfer position refers to a position located at the downstream side of the electrostatic latent image carrying surface in a moving direction thereof by rotation of the photosensitive drum 42 with respect to a position where the electrostatic latent image carrying surface faces the charging unit 43. The transfer roller 44 is configured to rotate in a rotation direction in conjunction with the photosensitive drum 42 (i.e., a direction opposite to the rotation direction of the photosensitive drum 42) when an image is formed. Further, the transfer roller 44 is configured to transfer the toner image carried on the circumferential surface of the photosensitive drum 42 onto the sheet S by a predetermined voltage which is applied between the photosensitive drum 42 and the transfer roller 44.

The toner case 45 which is a portion of the casing of the process cartridge 4 (configures the casing of the process cartridge 4 together with the process case 41) is configured to be attached to or detached from the process case 41. That is, the toner case 45 is configured to be easily attached to or detached from the process case 41 for its replacement or maintenance. The toner case 45 is a box-like member made of synthetic resin having an electrical insulating property, and accommodates toner which is powdered dry developer in a space therein.

The toner case 45 is formed with an opening having a longitudinal direction in the sheet width direction at a position facing the photosensitive drum 42 when it is mounted on the process case 41. The toner case 45 is provided with a developing roller 46 and a supply roller 47 at a position near the opening. Further, an agitator 48 is housed in the space for accommodating the toner inside the toner case 45. The developing roller 46, the supply roller 47, and the agitator 48 are rotatably supported by the toner case 45.

The developing roller 46 is disposed parallel with the photosensitive drum 42 so as to face the electrostatic latent image carrying surface at a developing position which is at the downstream side from the position where the electrostatic latent image carrying surface faces the charging unit 43, and at the upstream side from the transfer position. Further, the developing roller 46 is configured to carry a thin toner layer on its circumferential surface of a smooth cylindrical shape. The developing roller 46 is rotated in a direction opposite to the rotation direction of the photosensitive drum 42 to supply the charged toner to the electrostatic latent image carrying surface. That is, the developing roller is rotated in a rotation direction in which the moving direction of the circumferential surface of the developing roller 46 is identical to the moving direction of the electrostatic latent image carrying surface at the developing position described above.

The supply roller 47 is disposed between the space for accommodating toner inside the toner case 45 and the developing roller 46 to cause the toner accommodated in the toner case 45 to be carried on the circumferential surface of the developing roller 46. The agitator is provided to agitate the toner accommodated in the toner case 45 through the rotation and to send a portion of the toner to the supply roller 47.

The scanner unit 5 is disposed above the process cartridge 4. The scanner unit 5 is configured to form the electrostatic latent image on the electrostatic latent image carrying surface by generating a laser beam (see the single-dotted line in the drawing) modulated in accordance with image data and scanning the laser beam on the electrostatic latent image carrying surface uniformly charged by the charging unit 43 along the sheet width direction.

Specifically, the scanner unit 5 includes a polygon mirror 51, lenses 52 and 53, and reflectors 54, 55 and 56. The scanner unit 5 scans the above-described laser beam emitted from a light emitting portion (not illustrated) along the sheet width direction by the polygon mirror 51, and the laser beam passes the lens 52, the reflector 54, the lens 53, and the reflector 56 to irradiate the electrostatic latent image carrying surface.

The fixing unit 6 (an example of a fixing device) is disposed at the downstream side in the sheet transport direction with respect to the above-described transfer position (position where the photosensitive drum 42 faces the transfer roller 44). The fixing unit 6 is configured to thermally fix a toner image on the sheet S by heating and pressing (nipping) the sheet S carrying (toner is electrostatically adhered in an image shape) the toner image.

First Illustrative Embodiment

<Detailed Configuration of Fixing Unit>

Figure 2:
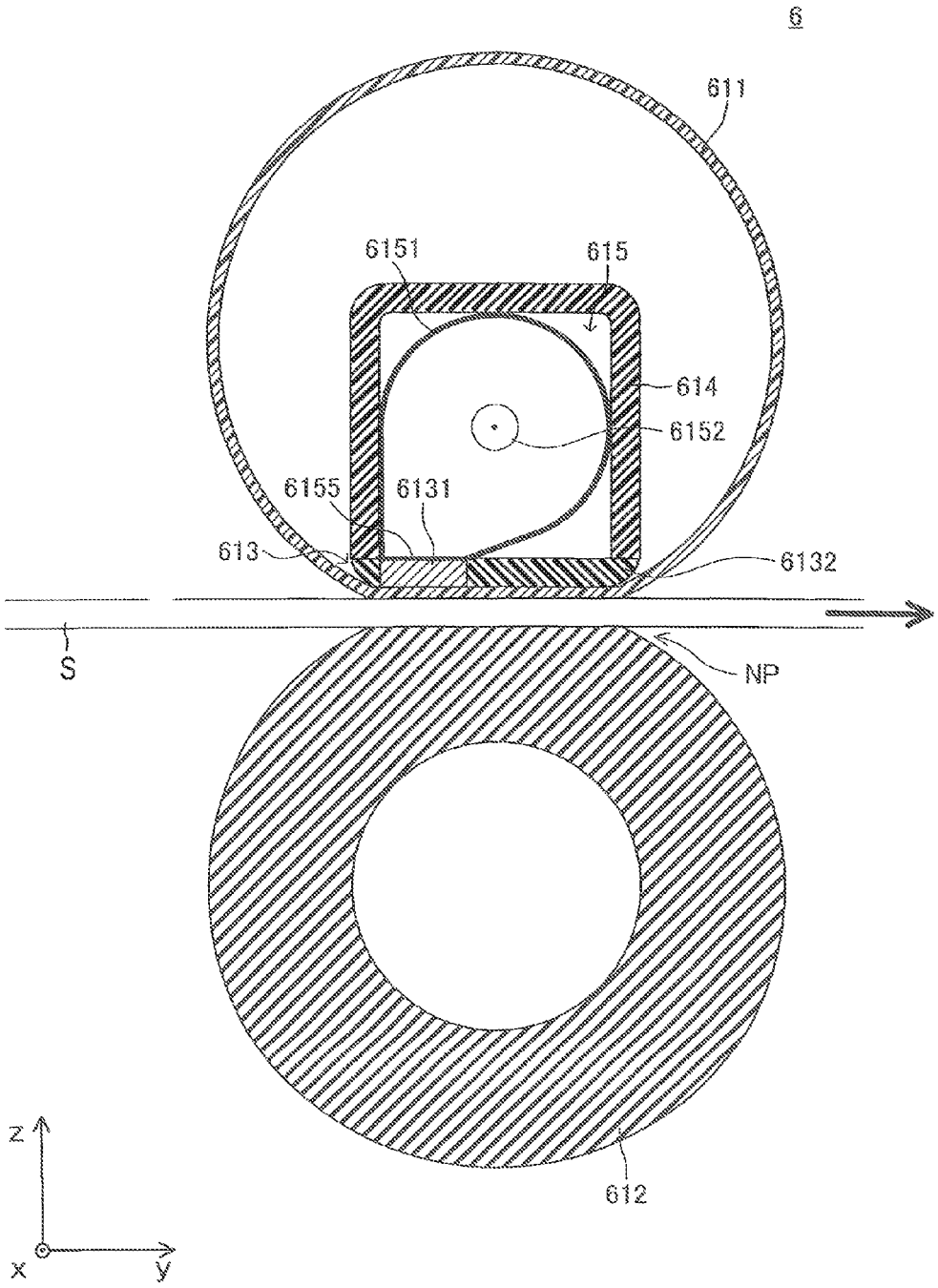
FIG. 2 is a side sectional view schematically illustrating the configuration of a fixing unit shown in FIG. 1 according to a first illustrative embodiment.

FIG. 2 is a side sectional view schematically illustrating the configuration of the fixing unit 6 according a first illustrative embodiment. The feature of the configuration of the fixing unit 6 according to this illustrative embodiment will be described in detail with reference to FIG. 2.

The fixing unit 6 includes a fixing belt 611, a press roller 612, a nip plate 613, a stay 614, and a heat source device 615.

The fixing belt 611 is an endless belt formed in a tubular shape and has a heat resistance and flexibility. The fixing belt 611 is held at a predetermined position by a guide member (not illustrated), and is supported to be rotatable around a shaft parallel with the sheet width direction.

The press roller 612 (an example of a facing member) is disposed to face the outer circumference of the fixing belt 611. The press roller 612 is a roller-type member with an elastically deformable rubber layer formed on its outer circumference, and is supported to be rotatable around a shaft parallel with the sheet width direction.

The nip plate 613 (an example of a nip member) is a plate-like member and is accommodated in the fixing belt 611 to face the press roller 612 with the fixing belt 611 being interposed therebetween. The nip plate 613 comes into contact with the inner peripheral surface of the fixing belt 611 to elastically deform the above-described rubber layer and is provided to cause a nip portion NP to have a predetermined width along the sheet transport direction.

The nip plate 613 has a heat transfer member 6131 and a heat insulating member 6132. The heat transfer member 6131 is made of a material having thermal conductivity higher than that of the heat insulating member 6132. Specifically, in this illustrative embodiment, the heat transfer member 6131 is made of a metal having high thermal conductivity. The heat insulating member 6132 is made of a synthetic resin material having low thermal conductivity and a high heat-resisting property.

The heat transfer member 6131 is provided at a position corresponding to a portion of the nip portion NP when seen from a side view (seen from a side sectional view), so as to transfer the heat from the heat source device 615 to the nip portion NP. Specifically, the heat transfer member 6131 is provided at the upstream side of the nip portion NP in the sheet transport direction.

The heat insulating member 6132 is a part of the nip plate 613 except for the heat transfer member 6131. The heat insulating member 6132 is provided at the portions at the upstream side and the downstream side with respect to the heat transfer member 6131 in the sheet width direction and at the portions adjacent to both ends of the heat transfer member 6131 in the sheet width direction (see FIG. 3).

Figure 3:
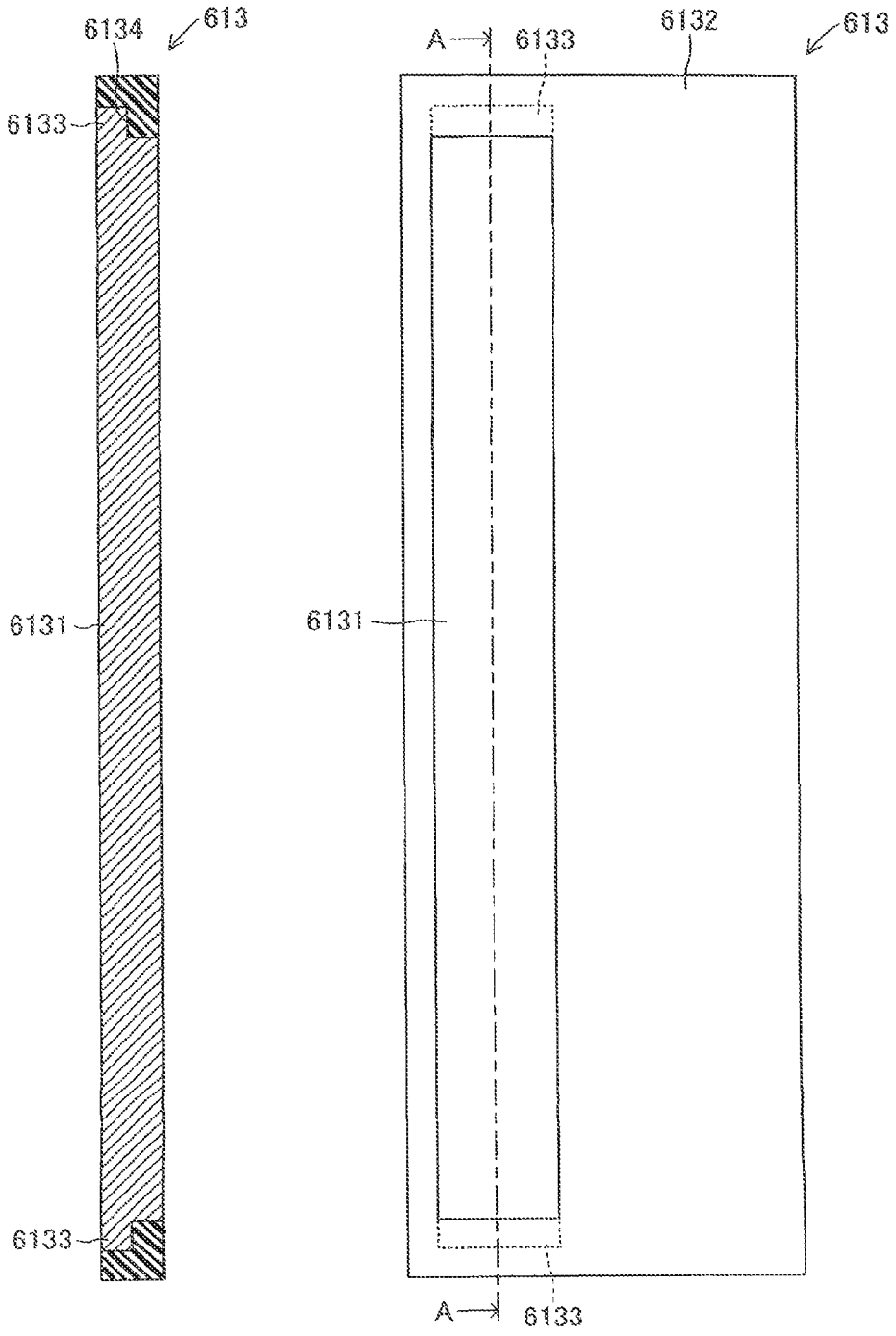
FIG. 3 is an enlarged bottom view and an enlarged cross-sectional view of a nip plate shown in FIG. 2.

FIG. 3 is an enlarged bottom view and an enlarged cross-sectional view of the nip plate 613 shown in FIG. 2. In FIG. 3, the right side is the bottom view (view seen from the lower side in FIG. 2, that is, the nip portion NP side), and the left side is the cross-sectional view taken along the line A-A of the bottom view. As illustrated in FIG. 3, the heat transfer member 6131 is supported by the heat insulating member 6132 through a flange 6133.

In this illustrative embodiment, the flange 6133 is provided such that both end portions in the sheet width direction which is the longitudinal direction of the heat transfer member 6131 are integral with the heat transfer member 6131 without a joint. The heat insulating member 6132 has an engaging groove 6134 which receives the flange 6133 to engage therewith, at a position corresponding to the flange 6133.

Referring again to FIG. 2, the stay 614 is a substantially U-shaped member (substantially reversed U-shaped or n-shaped in the drawing) which is opened toward the nip plate 613 when seen from a side sectional view, and is disposed (received) in the fixing belt 611 to support the nip plate 613. The stay 614 is made of a synthetic resin material having low thermal conductivity and a high heat-resisting property. Specifically, in this illustrative embodiment, the stay 614 is made of the same material as that of the heat insulating member 6132 in the nip plate 613.

In this illustrative embodiment, the stay 614 is joined to the nip plate 613 to support the end portion of the nip plate 613 and form a substantially closed space therein. That is, both end portions of the stay 614 in the sheet width direction are provided with a pair of lateral plates which are perpendicular to the sheet width direction.

The heat source device 615 is disposed in the fixing belt 611 to heat the nip portion NP. Specifically, the heat source device 615 is accommodated in a substantially closed space enclosed by the nip plate 613 and the stay 614. The heat source device 615 includes a reflector 6151 and a heater 6152.

The reflector 6151 is a tubular member, when seen from a side sectional view, formed by bending an aluminum (alloy) plate, and is supported from the outside by the stay 614. An inner surface of the reflector 6151 is subjected to a mirror process to increase a reflectance of infrared rays (including far infrared rays) generated from the heater. The reflector 6151 is opened toward the heat transfer member 6131 in the nip plate 613 and is not opened toward the heat insulating member 6132 when seen from a side sectional view. Accordingly, radiant heat generated from the heater 6152 is intensively radiated onto the heat transfer member 6131 only.

The heater 6152 is a heating element configured by a halogen lamp, and is configured to generate the radiant heat by electric conduction. Further, in this illustrative embodiment, the heat transfer member 6131 has a blackbody surface 6155 formed by black paint on its surface facing the heater 6152.

<Functions and Effects of First Illustrative Embodiment>

In the fixing unit 6 according to this illustrative embodiment, the radiant heat generated from the heater 6152 is received by the heat transfer member 6131. The heat received by the heat transfer member 6131 is radiated toward the nip portion NP, so that the nip portion NP is heated.

In this configuration, the heat transfer member 6131 is provided at the position corresponding to a portion of the nip portion NP (i.e., a portion of the nip portion NP in the sheet transport direction) when seen from a side sectional view. For this reason, the heated portion of the nip portion NP (i.e., a portion of the nip portion NP in the sheet transport direction) is not the whole portion of the nip portion NP, but is concentrated on a relatively narrow region of the portion. Accordingly, the toner carried on the sheet S is intensively heated in a short time while the heat transfer to the sheet S itself is suppressed as possible.

In particular, in the configuration of this illustrative embodiment, since the heat transfer member 6131 is provided at a portion of the upstream side in the nip portion NP when seen from a side sectional view, the heat intensively flows in the portion. Thus, the toner is softened sufficiently at the upstream side from the center portion of the nip portion NP where the maximum pressure is generated in the sheet transport direction. Then, since the toner is pressed against the sheet S in the sufficiently softened state, the toner image is reliably fixed on the sheet S. Therefore, the configuration of this illustrative embodiment can obtain a good fixing strength and fixing efficiency, thereby further reducing the electric power and shortening the warm-up time.

Further, in the configuration of this illustrative embodiment, the portion of the nip portion NP at the downstream side from the heat transfer member 6131 in the sheet transport direction has a relatively low temperature. For this reason, it is possible to suppress a hot offset generated at the portion due to the softening or melting of the toner, thereby improving the image quality after fixing.

Next, it will be described the result of evaluating the fixing strength obtained for the configuration of this illustrative embodiment through a numerical computation. A calculating method of the fixing strength is described in detail in "Basics and Applications of Electrophotography" (The Society of Electrophotography of Japan, Corona Publishing Co., Ltd (1988)), and a portion thereof is extracted below.

The fixing strength F is represented by Equation 1 below from pressure P in the nip member and toner viscosity μ:

Equation 1

$$F = \int_0^{t_{dwell}} \frac{P(t)}{\mu(T(t))} dt \tag{1}$$

According to Equation 1, the toner viscosity μ depends on temperature T. In the numeric computation, a time of the sheet passing the nip portion is discretized by ΔT, and the toner viscosity μi is obtained from pressure Pi and temperature Ti for every step i while passing, thereby calculating the fixing strength F by Equation 2 below:

Equation 2

$$F = \sum_i \frac{P_i}{\mu_i} \Delta t \tag{2}$$

Figure 4:
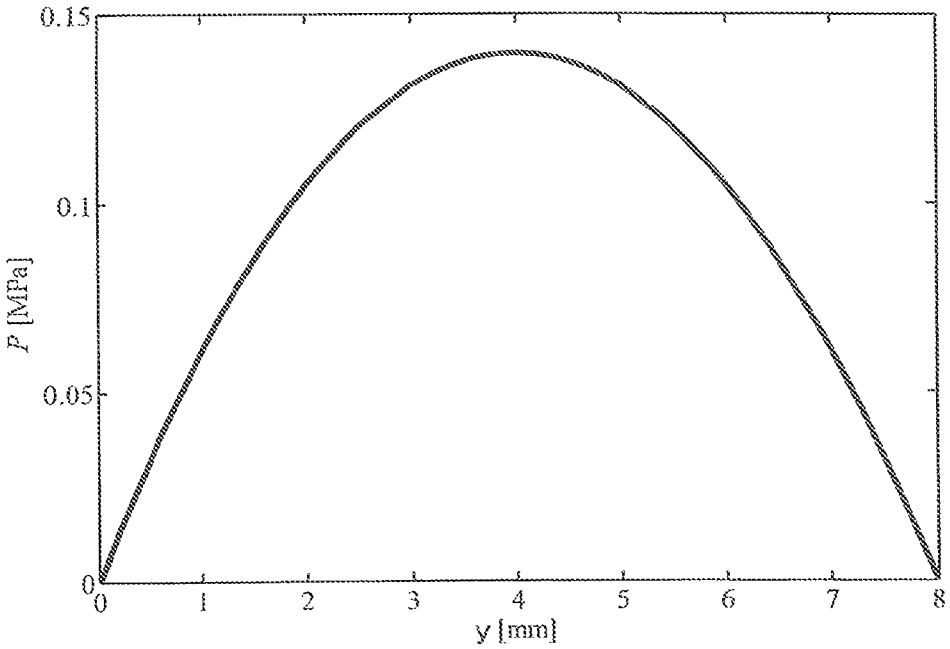
FIG. 4 is a graph illustrating a pressure distribution along a sheet transport direction of a nip portion shown in FIG. 2.

The pressure P is set while assuming that the elastic roller is pressed against a flat surface, and a pressure distribution on the nip portion along the sheet transport direction is assumed as a parabolic distribution on the basis of the contact theory of Heltz (see FIG. 4; y denotes a distance from an upstream end of the nip portion NP in the sheet transport direction illustrated in FIG. 2 while y=0 corresponds to the upstream end). In the pressure distribution graph illustrated in FIG. 4, the maximum value of the pressure is set to 0.14 MPa.

Figure 5:
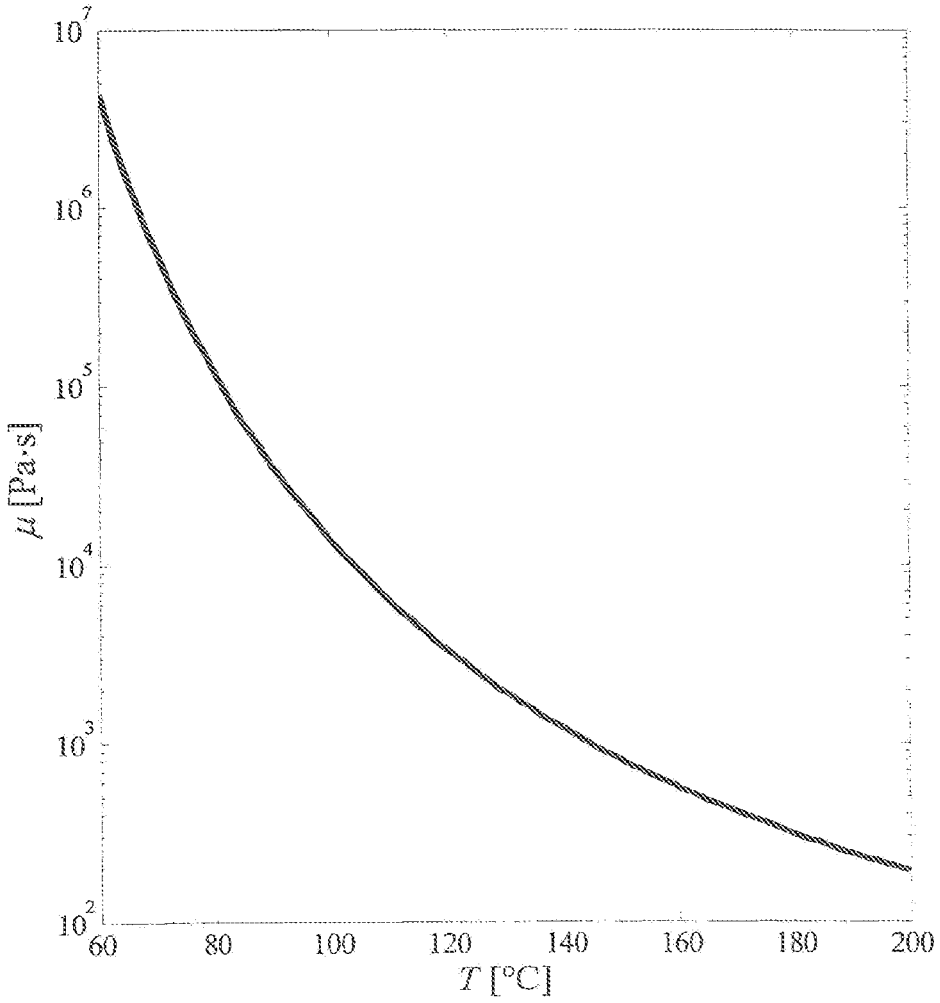
FIG. 5 is a graph illustrating a temperature dependence of toner viscosity.

The toner viscosity μ is calculated using the Andrade's Equation represented by Equation 3 below. In Equation 3, coefficients A and B are obtained by fitting a measured value (see FIG. 5).

Equation 3

$$\mu(T) = A\exp\left(\frac{B}{T}\right) \quad (3)$$

Figure 6:
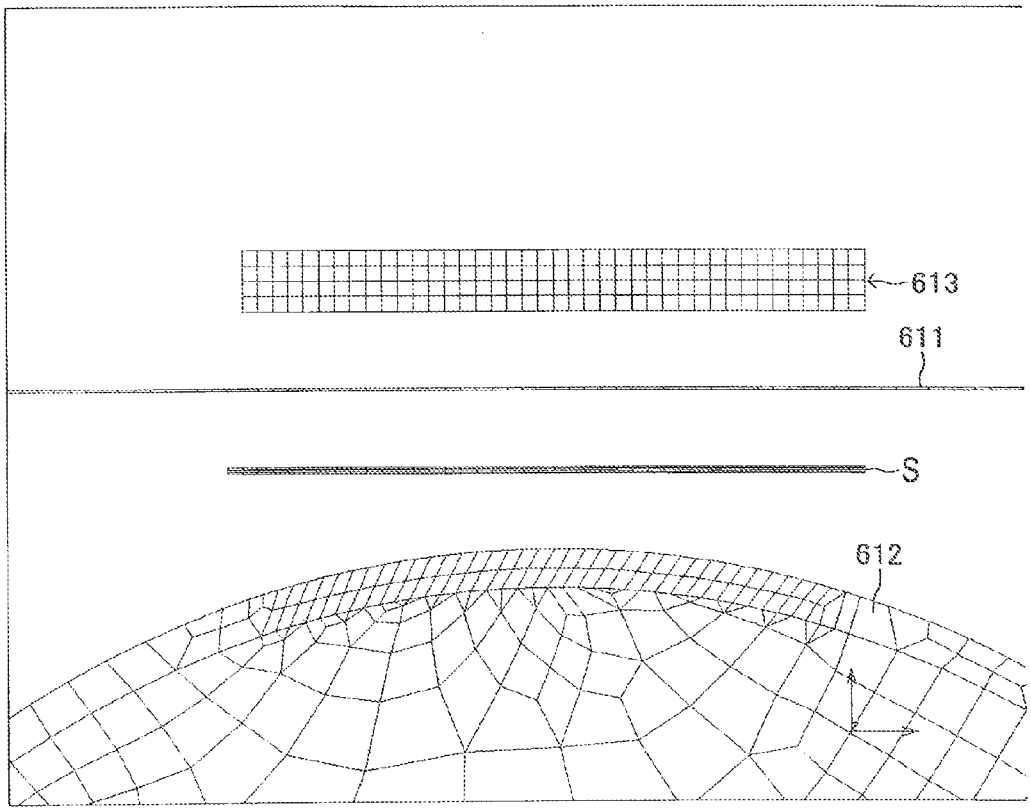
FIG. 6 is a diagram illustrating a calculation mesh to analyze a heat flow (heat conduction) by computer simulation.

In Equations 1 and 3, the toner temperature T is obtained by performing computer simulation using computer software based on a finite element method which can be commercially available. FIG. 6 is a diagram illustrating a calculation mesh to analyze a heat flow (heat conduction) by the computer simulation.

In FIG. 6, the nip plate 613, the fixing belt 611, the sheet S, and the press roller 612 are shown as being separated each other, for the purpose of illustration. However, these parts are set to be brought into thermally contact with each other. Further, the fixing belt 611, the sheet S, and the press roller 612 are mathematically set to be moved in a speed corresponding to an image forming speed (specifically, corresponding to 30 ppm in a case where A4 sheet is transported in a longitudinal direction: ppm is an abbreviation of "page per minute").

Typical boundary conditions are set as follows: radiant heat corresponding to 800 W is uniformly applied to the upper surface of the heat transfer member 6131; and a shaft of the press roller 612 which is made of stainless steel is fixed at a room temperature (25° C.).

Further, in the above computation, the heat transfer member 6131 (see FIG. 2) of the nip plate 613 is made of A5052 aluminum alloy, and the heat insulating member 6132 (see FIG. 2) is made of PFA (tetrafluoroethylene-perfluoroalkylvinylether copolymer). The fixing belt 611 is made of polyimide, and the press roller 612 is made of silicone rubber, the surface of which is coated by tube-like PFA resin.

Figure 7:
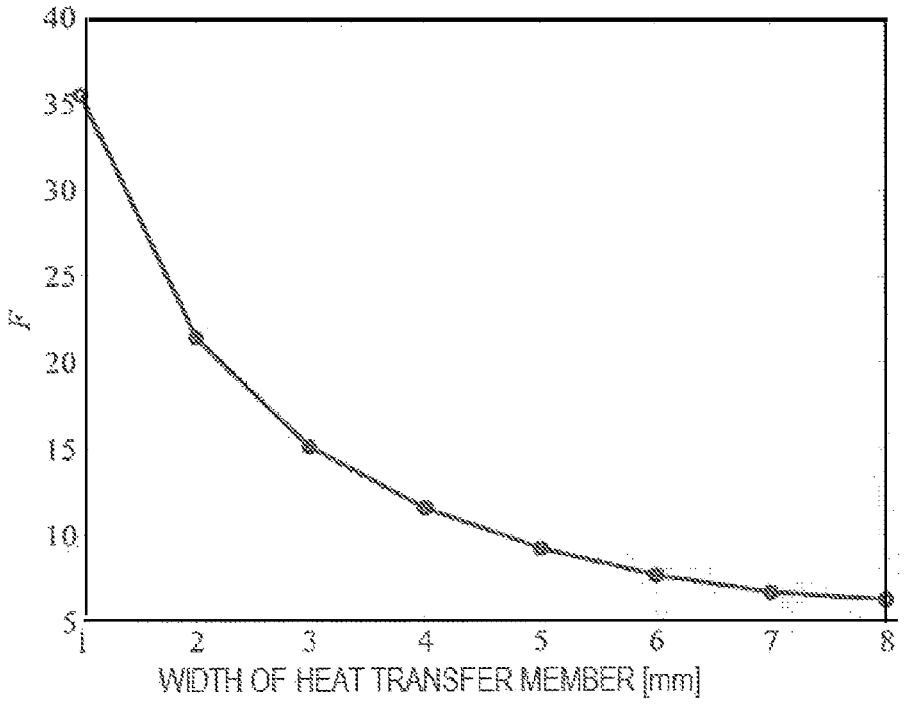
FIG. 7 is a graph illustrating variation of fixing strength F in a case where a width of a heat transfer member in a sheet transport direction is changed while a width of the nip plate and the nip portion shown in FIG. 2 in the sheet transport direction is constant.

FIG. 7 is a graph illustrating variation of the fixing strength F in a case where the width of the heat transfer member 6131 in the sheet transport direction is changed while the width of the nip plate 613 and the nip portion NP shown in FIG. 2 in the sheet transport direction is constant. In the computation, it is assumed that the width of the nip portion NP in the sheet transport direction is 8 mm, and the heat transfer member 6131 is provided at the upstream end of the nip portion NP in the sheet transport direction. Further, in the graph, a width of a heat conducting part on a horizontal axis is a width of the heat transfer member 6131 in the sheet transport direction. That is, if a value of the horizontal axis is 1, the heat transfer member 6131 is provided over an area between the upstream end of the nip portion NP in the sheet transport direction and a position displaced by 1 mm to the downstream side from the upstream end in the sheet transport direction.

As being apparent from the result of FIG. 7, it is observed that the smaller the width of the heat transfer member 6131 in the sheet transport direction, the higher the fixing strength becomes.

<Modifications of the First Illustrative Embodiment>

Specific modified examples (modification) to the first illustrative embodiment will be described. Of course, the modification to the illustrative embodiment is not limited to the following examples.

In the following description of the modifications, in principle, the same symbols as used in the above-described illustrative embodiment are used for components having the same configurations and functions explained in the above-described illustrative embodiment. And, for descriptions of such components, the descriptions in the above-described illustrative embodiment are quoted as long as they do not technically contradict. Obviously, the scope of the present invention is not limited by the modifications below. In addition, a plurality of modifications can be combined, appropriately, as long as they do not technically contradict. Furthermore, a part of the above-described illustrative embodiment and a part of the modification can be appropriately combined.

The heat source device of the present invention is not limited to one utilizing a halogen lamp. Specifically, for example, a planar heater is used as such a heating element. In this instance, the planar heater is provided to be brought into close contact with the heat transfer member 6131. In this instance, the blackbody surface 6155 is not necessary.

Referring to FIG. 2, the heat transfer member 6131 may be made of a metal having high thermal conductivity, such as aluminum (alloy) or copper. Further, the heat transfer member 6132 may be made of a metal having low thermal conductivity, such as stainless steel, ceramics, or a synthetic resin material (liquid crystal polymer, polyimide, polyamide imide, or the like) having the low thermally conductivity and the high heat-resisting property.

FIGS. 8A to 8D are side sectional views illustrating modifications of the configuration of the nip plate 613 shown in FIG. 2.

Figure 8A:
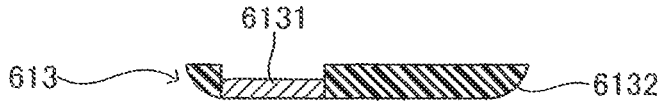
FIG. 8A is a side sectional view illustrating a modification of the configuration of the nip plate shown in FIG. 2.

As illustrated in FIG. 8A, the heat transfer member 6131 may have a thickness thinner than the heat insulating member 6132. In this case, as the heat capacity of the heat transfer member 6131 is decreased, the temperature is quickly increased.

Figure 8B:
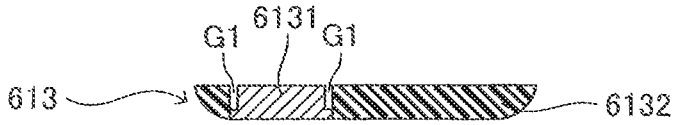
FIG. 8B is a side sectional view illustrating another modification of the configuration of the nip plate shown in FIG. 2.

As illustrated in FIG. 8B, the heating side (upper side in the drawing; that is, side opposite to the heat source device 615) may be provided with a gap G1 between the heat transfer member 6131 and the heat insulating member 6132. The gap G1 is provided on both end portions of the heat transfer member 6131 in the sheet transport direction and the sheet width direction.

With this configuration, the hot portion of the heat transfer member 6131 may not be brought into contact with the heat insulating member 6132. Therefore, according to this configuration, a material having an excessively high heat-resisting property may not be used as the material of the heat insulating member 6132. That is, a cheaper material can be selected for the heat insulating member 6132.

The gap G1 may be provided at the heat transfer member 6131 side as illustrated in FIG. 8B, or may be provided at the heat insulating member 6132 side.

As illustrated in FIG. 8A, in the case where the heat transfer member 6131 is made to be thinner than the heat insulating member 6132, there is a concern about the heat transfer member 6131 is bent in the sheet width direction which is the longitudinal direction. In this instance, as illustrated in FIG. 8C, the heat transfer member 6131 may be provided with a flange 6135, which is a projection to engage the heat transfer member 6131 and the heat insulating member 6132, along the sheet width direction which is the longitudinal direction.

With this configuration, the heat transfer member 6131 is reliably prevented from being bent in the sheet width direction which is the longitudinal direction. According to the configuration, the heat transfer member 6131 is reliably held.

Figure 8C:
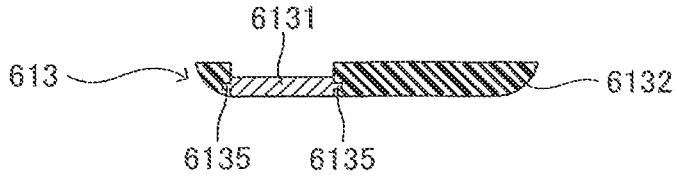
FIG. 8C is a side sectional view illustrating a further modification of the configuration of the nip plate shown in FIG. 2.

Further, the flange 6135 may be provided at the heat transfer member 6131 side, as illustrated in FIG. 8C. In this instance, the heat insulating member 6132 is provided with a groove to accommodate the flange 6135 therein. On the other hand, the flange 6135 may be provided at the heat insulating member 6132 side. In this instance, the heat transfer member 6131 is provided with a groove to accommodate the flange 6135 therein.

Figure 8D:
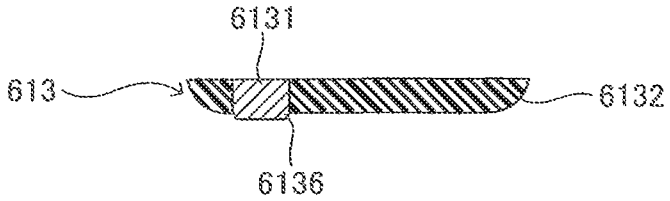
FIG. 8D is a side sectional view illustrating a further modification of the configuration of the nip plate shown in FIG. 2.

As illustrated in FIG. 8D, the heat transfer member 6131 may be provided with a projection 6136. The projection 6136 protrudes toward the nip portion NP (see FIG. 2) further than the heat insulating member 6132. With the configuration, the contact between the heat transfer member 6131, the fixing belt 611, and the sheet S is improved at the position corresponding to the projection 6136 of the nip portion NP (see FIG. 2), thereby further improving the heat transfer efficiency at the position of the nip portion NP by the heat transfer member 6131.

Referring again to FIG. 2, the heat insulating member 6132 and the stay 614 may be made of different materials.

Figure 9:
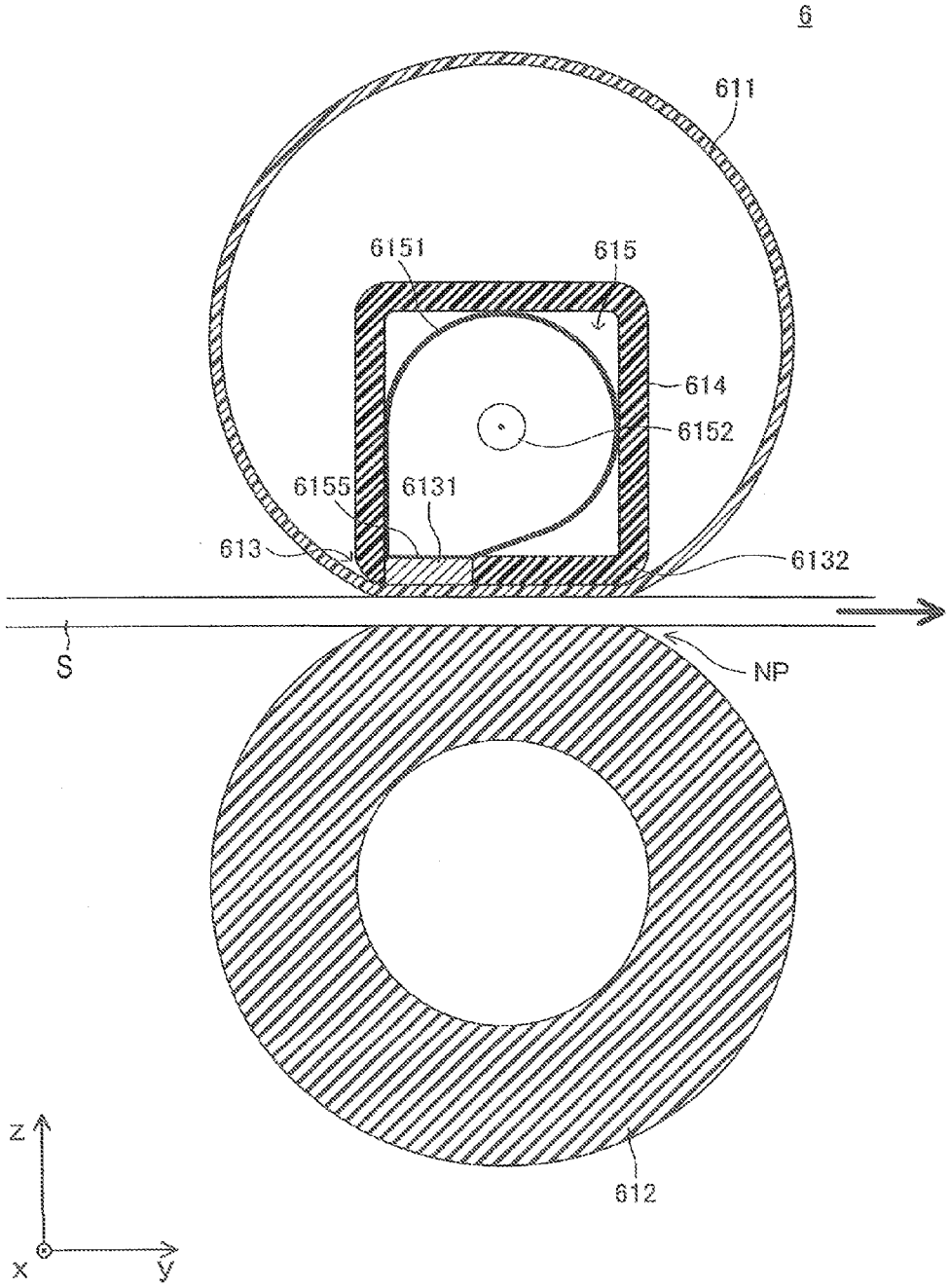
FIG. 9 is a side sectional view schematically illustrating a modification of the configuration of the fixing unit shown in FIG. 2.

FIG. 9 is a side sectional view schematically illustrating a modification of the configuration of the fixing unit 6 shown in FIG. 2. In the case where the heat insulating member 6132 and the stay 614 are made of the same material, the stay 614 and the heat insulating member 6132 may be formed integrally with each other, as illustrated in FIG. 9. With this configuration, the strength (rigidity) of the nip plate 613 is improved.

Second Illustrative Embodiment

<Detailed Configuration of Fixing Unit>

Figure 10:
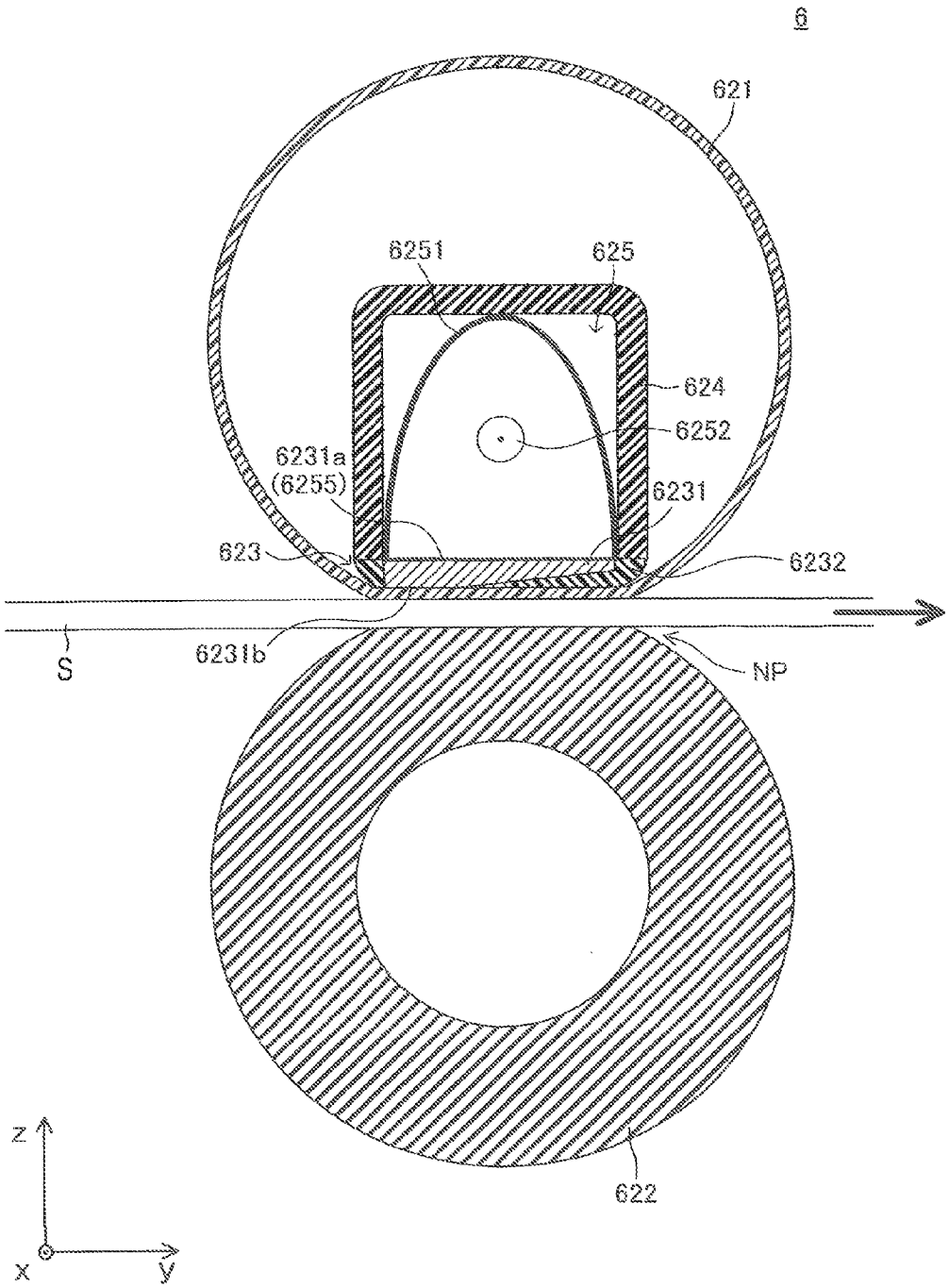
FIG. 10 is a side sectional view schematically illustrating the configuration of the fixing unit shown in FIG. 1 according to a second illustrative embodiment.

FIG. 10 is a side sectional view schematically illustrating the configuration of a second illustrative embodiment of the fixing unit 6 shown in FIG. 1. The feature of the configuration of the fixing unit 6 according to this illustrative embodiment will be described in detail with reference to FIG. 10.

The fixing unit 6 includes a fixing belt 621, a press roller 622, a nip plate 623, a stay 624, and a heat source device 625.

The fixing belt 621 is an endless belt formed in a tubular shape and has a heat resistance and flexibility. The fixing belt 621 is held at a predetermined position by a guide member (not illustrated), and is supported to be rotatable around a shaft parallel with the sheet width direction.

The press roller 622 (an example of a facing member) is disposed to face the outer circumference of the fixing belt 621. The press roller 622 is a roller-type member with an elastically deformable rubber layer formed on its outer circumference, and is supported to be rotatable around a shaft parallel with the sheet width direction.

The nip plate 623 (an example of a nip member) is a plate-like member, and is accommodated in the fixing belt 621 to face the press roller 622 with the fixing belt 621 being interposed therebetween. The nip plate 623 comes into contact with the inner peripheral surface of the fixing belt 621 to elastically deform the above-described rubber layer and is provided to cause the nip portion NP to have a predetermined width along the sheet transport direction.

The nip plate 623 has a heat transfer member 6231 and a heat insulating member 6232. The heat transfer member 6231 is made of a material having thermal conductivity higher than that of the heat insulating member 6232. Specifically, in this illustrative embodiment, the heat transfer member 6231 is made of a metal having high thermal conductivity. The heat insulating member 6232 is made of a synthetic resin material having low thermal conductivity and a high heat-resisting property.

The heat transfer member 6231 has a heat receiving surface 6231*a* and a heat radiating surface 6231*b*. The heat radiating surface 6231*a* is a surface of the heat transfer member which faces the heat source device 625 and is provided to receive the heat from the heat source device 625. The heat radiating surface 6231*b* is a surface of the heat transfer member 6231 which faces the nip portion NP and comes in contact with an inner peripheral surface of the fixing belt 621 to radiate the heat toward the nip portion NP. The heat transfer member 6231 is provided to transfer the heat from the heat source device 625 through the heat receiving surface 6231 to the heat radiating surface 6231*b*.

The heat transfer member 6231 is formed in a trapezoidal shape when seen from a side sectional view such that the heat radiating surface 6231*b* has an area smaller than that of the heat receiving surface 6231*a*. Specifically, the heat receiving surface 6231*a* is the upper surface (surface at the side of the heat source device 625) of the nip plate 623, and is formed over the whole surface thereof facing the heat source device 625. On the other hand, the heat radiating surface 6231*b* is a portion of the lower surface (surface at the side of the nip portion NP) of the nip plate 623 when seen from a side view, and, specifically, is provided at the upstream portion of the nip portion NP in the sheet transport direction.

The heat insulating member 6232 is a part of the nip plate 623 except for the heat transfer member 6231. The heat insulating member 6232 is provided between the portion of the surface of the heat transfer member 6231 facing the nip portion NP except for the heat radiating surface 6231*b*, and the inner peripheral surface of the fixing belt 621. Further, the heat insulating member 6232 is provided at the position adjacent to both end portions of the heat transfer member 6231 in the sheet width direction.

The stay 624 is a substantially U-shaped member (substantially reversed U-shaped or n-shaped in the drawing) which is opened toward the nip plate 623 when seen from a side sectional view, and is disposed (received) in the fixing belt 621 to support the nip plate 623. The stay 624 is made of a synthetic resin material having low thermal conductivity and a high heat-resisting property. Specifically, in this illustrative embodiment, the stay 624 is made of the same material as that of the heat insulating member 6232 in the nip plate 623.

In this illustrative embodiment, the stay 624 is joined to the nip plate 623 to support the end portion of the nip plate 623 and form a substantially closed space therein. That is, both end portions of the stay 624 in the sheet width direction are provided with a pair of lateral plates which are perpendicular to the sheet width direction.

The heat source device 625 is disposed in the fixing belt 621 to heat the nip portion NP. Specifically, the heat source device 625 is accommodated in a substantially closed space enclosed by the nip plate 623 and the stay 624. The heat source device 625 includes an elliptical mirror 6251 and a heater 6252.

The elliptical mirror 6251 is a semi-elliptical member, when seen from a side sectional view, formed by bending an aluminum (alloy) plate, and is supported from the outside by the stay 624. An inner surface of the elliptical mirror 6251 is subjected to a mirror process to increase a reflectance of infrared rays (including far infrared rays) generated from the heater 6252. The elliptical mirror 6251 is opened toward the heat transfer member 6231 in the nip plate 623 when seen from a side sectional view. Accordingly, radiant heat generated from the heater 6252 is radiated onto the heat receiving surface 6231*a* of the heat transfer member 6231.

The heater 6252 is a heating element configured by a halogen lamp, and is configured to generate the radiant heat by electric conduction. Further, in this illustrative embodiment, the heat receiving surface 6231*a* has a blackbody surface 6255 formed by black paint.

<Functions and Effects of Second Illustrative Embodiment>

In the fixing unit 6 according to this illustrative embodiment, the radiant heat generated from the heater 6252 is received by the heat receiving surface 6231*a* of the heat transfer member 6231. The heat received by the heat receiving surface 6231*a* is radiated toward the nip portion NP from the heat radiating surface 6231*b* having the area smaller than that of the heat receiving surface 6231*a*, so that the nip portion NP is heated.

In the configuration, the heat radiating surface 6231*b* is provided at the position corresponding to a portion of the nip portion NP in the sheet transport direction, and has the area smaller than that of the heat receiving surface 6231*a*. For this reason, the heat received by the heat receiving surface 6231*a* having the relatively wide area is concentrated on the heat radiating surface 6231*b* having the relatively narrow area, so that a portion of the nip portion NP in the sheet transport direction is intensively heated. Accordingly, the toner carried on the sheet S is intensively heated in a short time, while the heat transfer to the sheet S is suppressed as possible. Therefore, according to this configuration, since good fixing strength and thermal efficiency (fixing efficiency) can be obtained, it promotes the increase in image forming speed, and further promotes the reduction in an electric power and the reduction in warm-up time.

Further, in the configuration of this illustrative embodiment, the portion of the nip portion NP at the downstream side from the heat transfer member 6231 in the sheet transport direction has a relatively low temperature. For this reason, it is possible to suppress a hot offset generated at the portion due to the softening or melting of the toner, thereby improving the image quality after fixing.

Next, the effects obtained by the configuration of this illustrative embodiment will be described with reference to the results evaluated by the numerical computation using the calculation mesh shown in FIG. 6 and Equations 1 to 3 described above.

Figure 11:
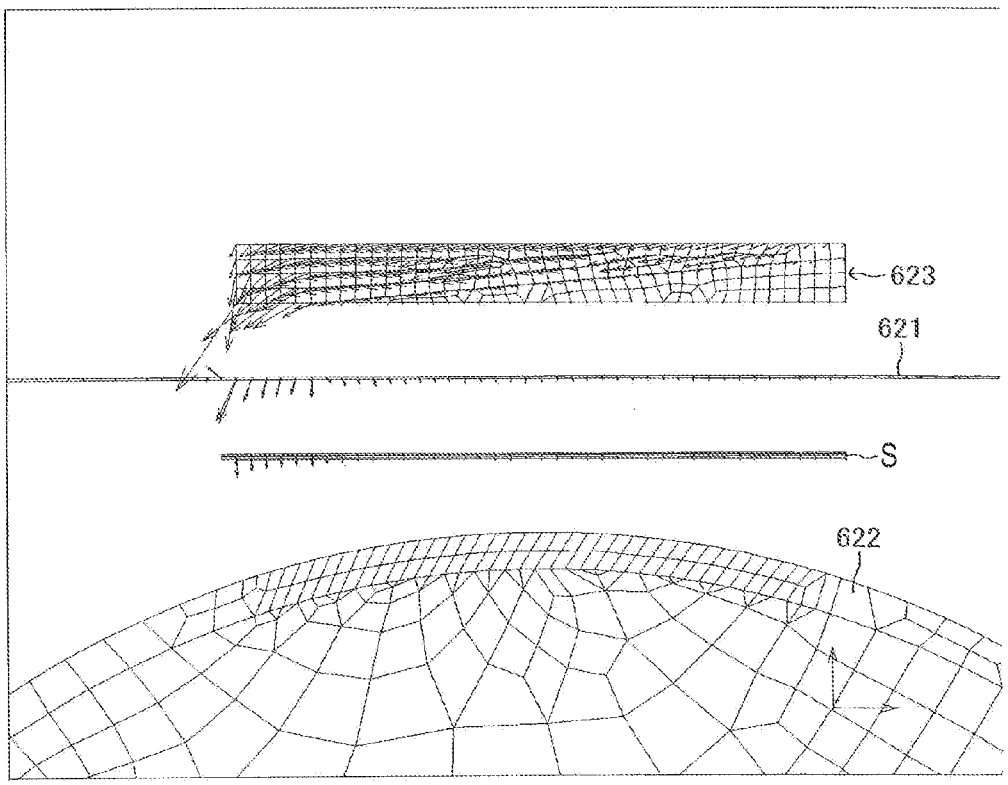
FIG. 11 is a diagram illustrating a heat flow (heat conduction) in the configuration shown in FIG. 10.
Figure 12:
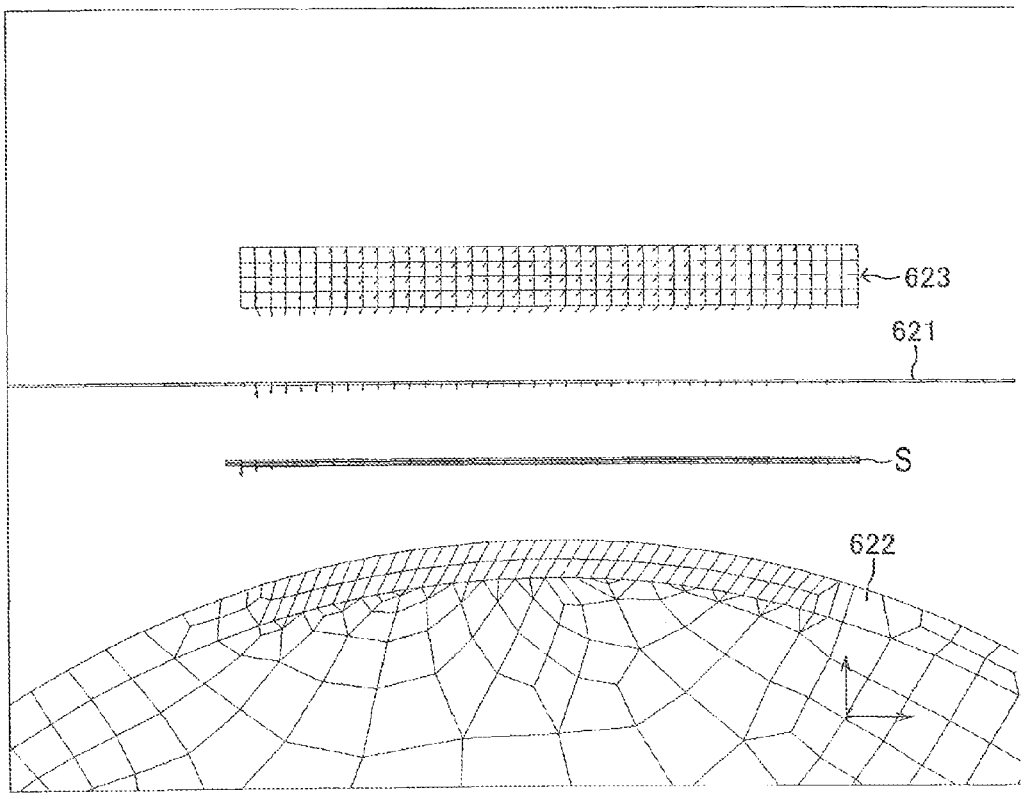
FIG. 12 is a diagram illustrating a heat flow (heat conduction) in the configuration of a comparative example in which the nip plate shown in FIG. 10 is made of a sheet of uniform aluminum alloy.

FIG. 11 is a diagram illustrating a heat flow (heat conduction) in the configuration shown in FIG. 10. FIG. 12 is a diagram illustrating a heat flow (heat conduction) in the configuration of a comparative example in which the nip plate 623 shown in FIG. 10 is made of one sheet of uniform aluminum alloy (A5052). In FIGS. 11 and 12, the heat flow is indicated by an arrow (vector).

As illustrated in FIG. 11, in the configuration of this illustrative embodiment, the heat uniformly applied to the upper surface (heat receiving surface 6231*a* of the heat transfer member 6231 in FIG. 10) of the nip plate 623 is concentrated on a portion of the nip portion at the upstream side. On the contrary, as illustrated in FIG. 12, in the configuration of the comparative example, the concentration of the heat flow does not occur.

Figure 13:
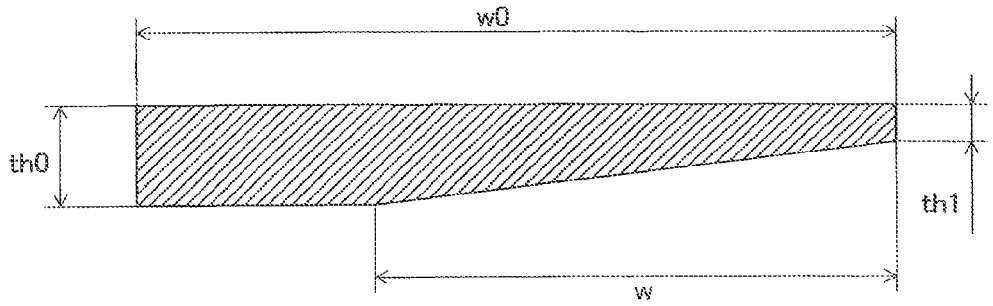
FIG. 13 is a diagram illustrating parameters on the shape of a heat transfer member to calculate fixing strength in the configuration shown in FIG. 10.

FIG. 13 is a diagram illustrating parameters on the shape of the heat transfer member 6231 to calculate the fixing strength in the configuration shown in FIG. 10. In the drawing, w indicates a position of the downstream end of the heat transfer surface 6231*a* in the sheet transport direction, in which the downstream end of the heat receiving surface 6231*a* of the heat transfer member 6231 shown in FIG. 10 is set as a base point. As the value of w is increased, the narrowing from the heat receiving surface 6231*a* to the heat radiating surface 6231*b* is increased. Further, in the computation of the fixing strength, it is assumed that the width of the nip portion is set to 8 mm, the width of the heat receiving surface 6231*a* in the sheet transport direction is set to w0=8 mm, and the thickness of the heat transfer member 6231 is set to th0=0.8 mm and th1=0.2 mm.

Figure 14:
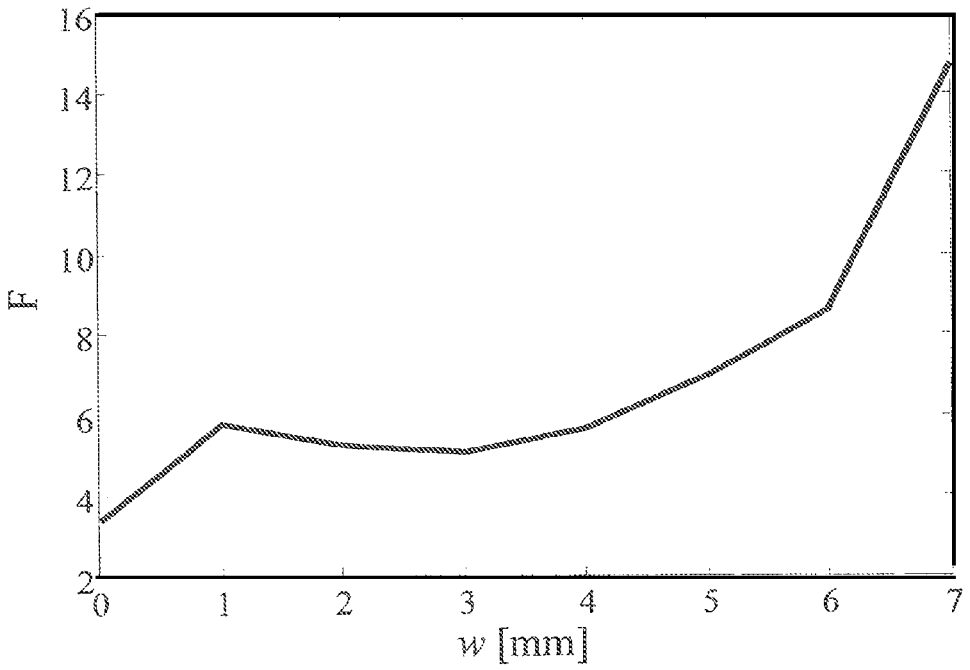
FIG. 14 is a graph illustrating variation of the fixing strength F (calculated result) when a value of w in FIG. 13 is changed.

FIG. 14 is a graph illustrating variation of the fixing strength F (calculated result) when a value of w in FIG. 13 is changed. As illustrated in FIG. 14, it is observed that as the narrowing from the heat receiving surface 6231*a* to the heat radiating surface 6231*b* is increased, the fixing strength is improved.

Figure 15:
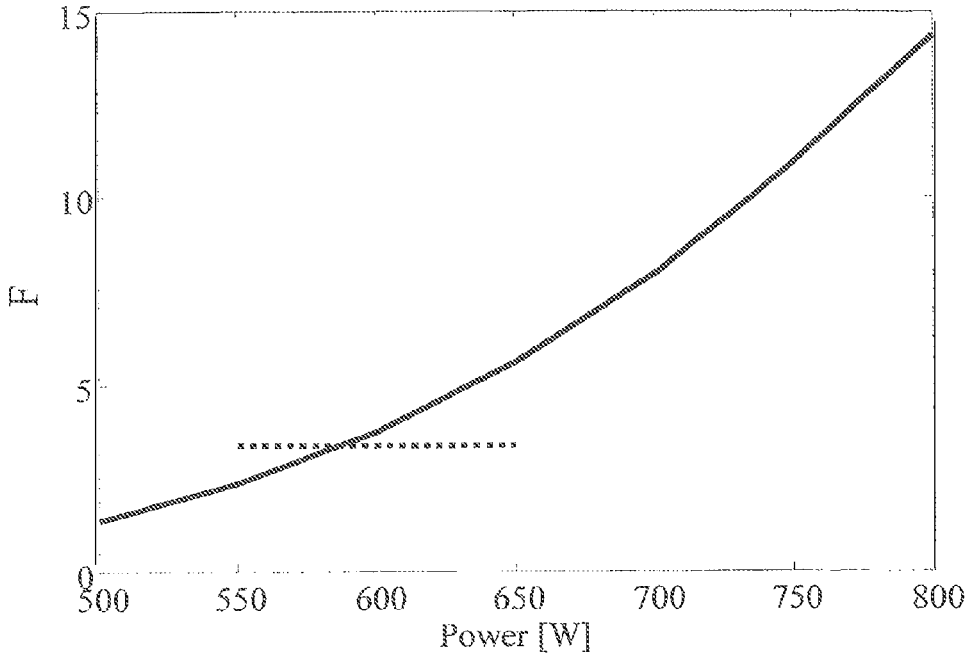
FIG. 15 is a graph illustrating variation of the fixing strength F (calculated result) when an amount of heat applied to a heat receiving surface is changed in a case of w=7 mm in FIG. 14.

FIG. 15 is a graph illustrating variation of the fixing strength F (calculated result) when an amount of the heat applied to the heat receiving surface 6231*a* is changed in the case of w=7 mm in FIG. 14. From the result of FIG. 15, it is observed that the fixing strength when the amount of applied heat is 800 W in the configuration of the comparative example illustrated in FIG. 12 (see the broken line in FIG. 15) is obtained by the amount of heat of 586 W in the case of w=7 mm.

<Modifications of Second Illustrative Embodiment>

Specific modified examples (modifications) of the second illustrative embodiment will be described. Of course, the modification to the illustrative embodiment is not limited to the following examples.

In the following description of the modifications, in principle, the same symbols as used in the above-described illustrative embodiment are used for components having the same configurations and functions explained in the above-described illustrative embodiment. And, for descriptions of such components, the descriptions in the above-described illustrative embodiment are quoted as long as they do not technically contradict. Obviously, the scope of the present invention is not limited by the modifications below. In addition, a plurality of modifications can be combined, appropriately, as long as they do not technically contradict. Furthermore, a part of the above-described illustrative embodiment and a part of the modification can be appropriately combined.

The heat source device of the present invention is not limited to one utilizing a halogen lamp. Specifically, for example, a planar heater is used as such a heating element. In this instance, the planar heater is provided to be brought into close contact with the heat receiving surface 6231*a*. In this instance, the blackbody surface 6255 is not necessary.

Referring to FIG. 10, the heat transfer member 6231 may be made of a metal having high thermal conductivity, such as aluminum (alloy) or copper. Further, the heat insulating member 6232 may be made of a metal having low thermal conductivity, such as stainless steel, ceramics, or a synthetic resin material (liquid crystal polymer, polyimide, polyamide imide, or the like) having the low thermally conductivity and the high heat-resisting property.

The heat insulating member 6232 may be formed integrally with the stay 624. Further, the heat insulating member 6232 may be made of a material different from that of the stay 624.

In the above-described illustrative embodiment, the heat receiving surface 6231*a* is provided over the almost whole surface of the upper surface of the nip plate 623 which faces the heat source device 625, but the present invention is not limited thereto. That is, a portion of the upper surface of the nip plate 623 which faces the heat source device 625 in the sheet transport direction may not have the heat receiving surface 6231*a*.

Figure 16:
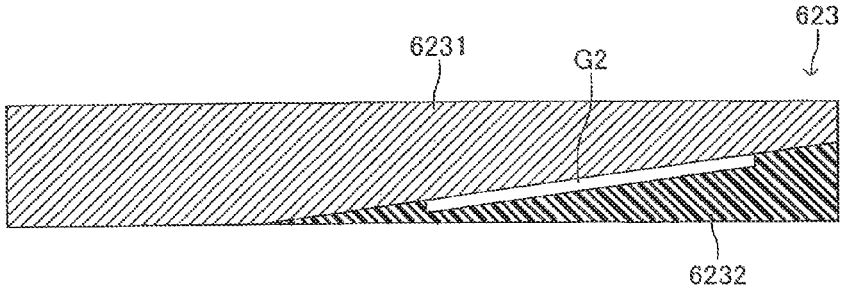
FIG. 16 is a side sectional view illustrating a modification of the configuration of the nip plate shown in FIG. 10.

FIG. 16 is a side sectional view illustrating a modification of the configuration of the nip plate 623 shown in FIG. 10. As illustrated in FIG. 16, a gap G2 may be provided between the heat transfer member 6231 and the heat insulating member 6232. Therefore, a concentration effect of the thermal energy is further improved. The gap G2 may be filled with air only. Alternatively, the gap G2 may be filled with material having a heat-resistant property (i.e., the heat conductivity is low) higher than that of the heat insulating member 6232.

Figure 17:
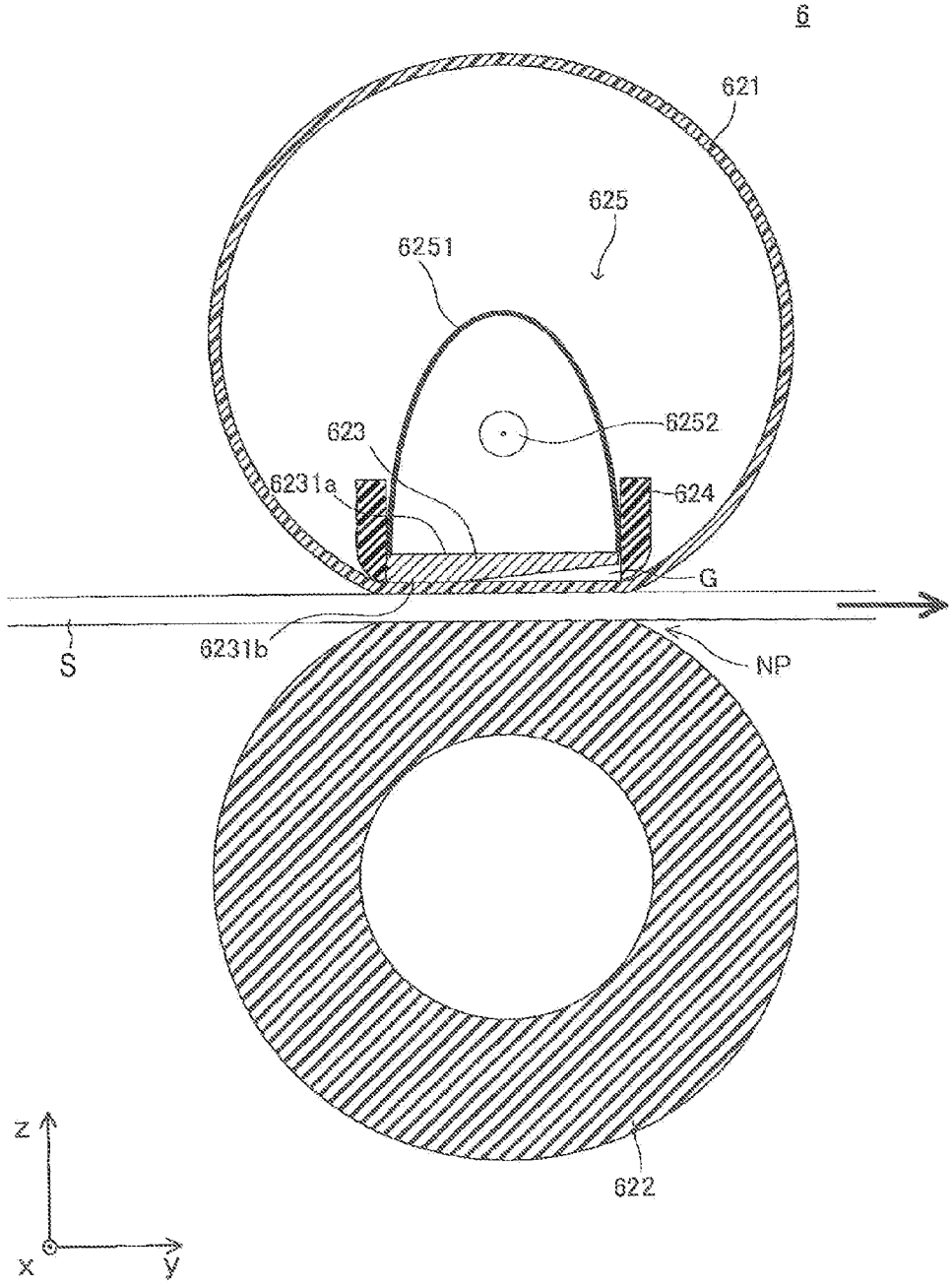
FIG. 17 is a side sectional view illustrating a modification of the configuration of the fixing unit shown in FIG. 10.

FIG. 17 is a side sectional view illustrating another modification of the configuration of the fixing unit 6 shown in FIG.

10. As illustrated in FIG. 17, the stay 624 may be formed in a top-opened shape (that is, a substantially rectangular shape when seen from a plan view).

Further, as illustrated in FIG. 17, the heat insulating member may be omitted. That is, a gap G may be formed between a surface of the heat transfer member 6231 facing the nip portion NP except for the heat radiating surface 6231*b* and the fixing belt 621.

Figure 18:
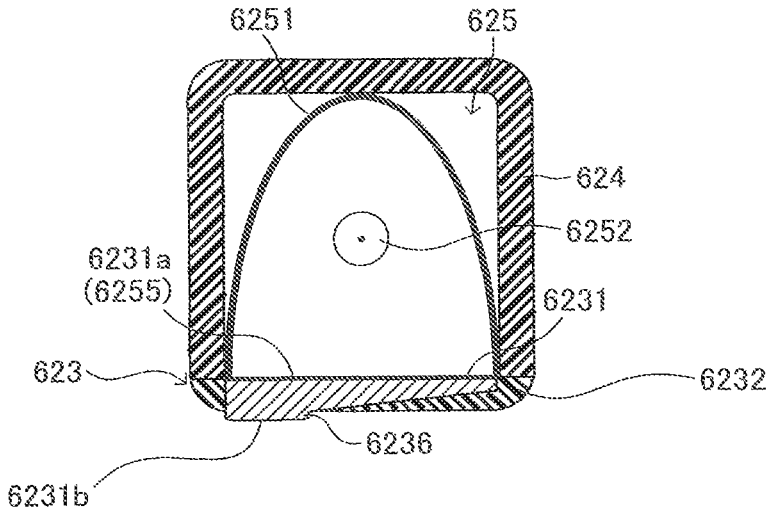
FIG. 18 is a side sectional view illustrating another modification of the configuration of the nip plate shown in FIG. 10.
Figure 18:
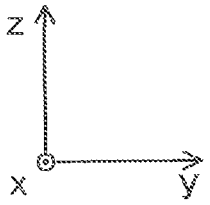

FIG. 18 is a side sectional view illustrating another modification of the configuration of the nip plate 623 shown in FIG. 10. As illustrated in FIG. 18, the heat transfer member 6231 may be provided with a projection 6236. The projection 6236 is provided to protrude toward the nip portion NP (see FIG. 10) further than the heat insulating member 6232. With the configuration, the contact between the heat transfer member 6231, the fixing belt 621, and the sheet S is improved at the position corresponding to the projection 6236 of the nip portion NP (see FIG. 10), thereby further improving the heat transfer efficiency at the position of the nip portion NP by the heat transfer member 6231.

Third Illustrative Embodiment

<Details of Configuration of Fixing Unit>

Figure 19:
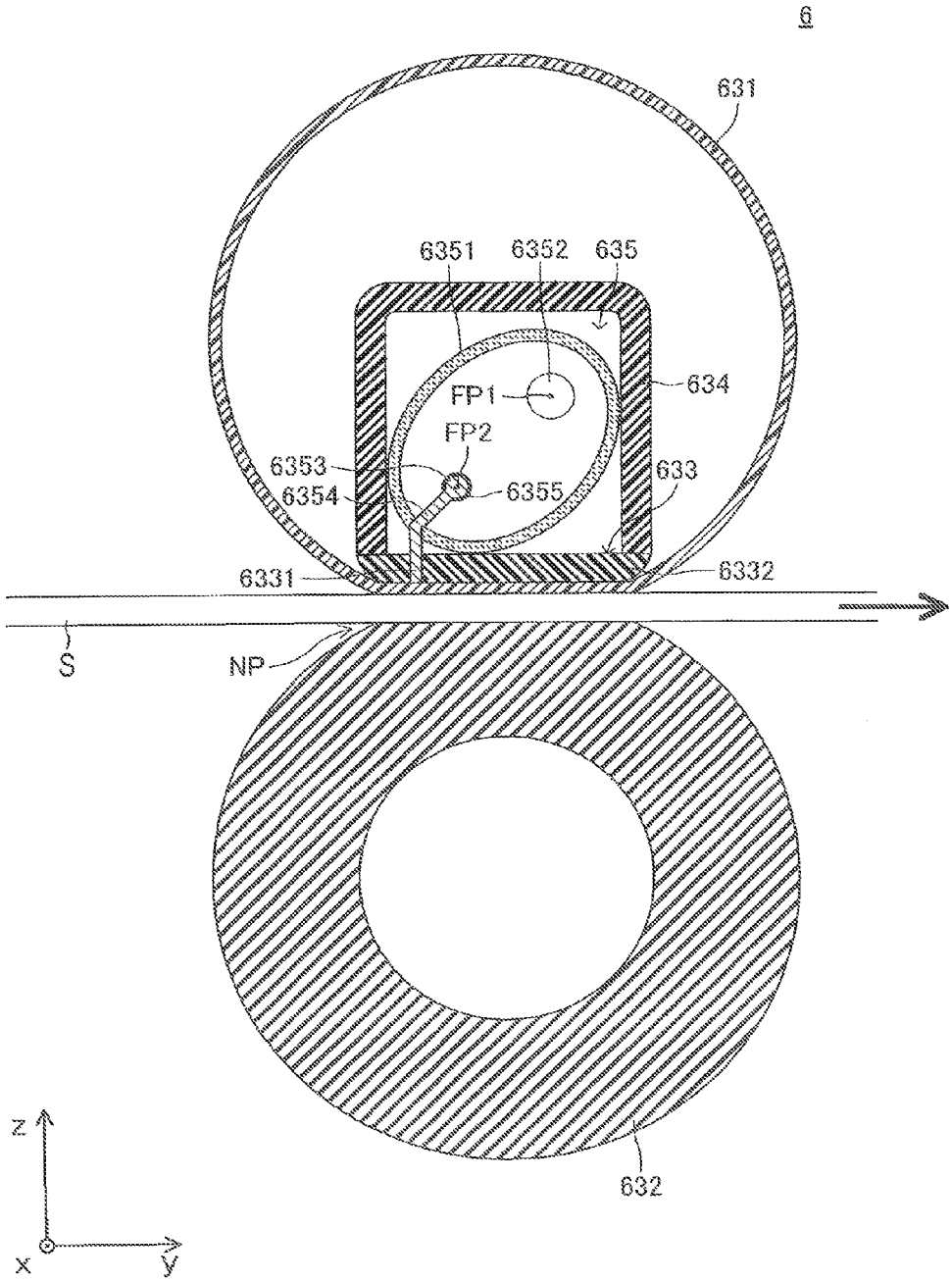
FIG. 19 is a side sectional view schematically illustrating the configuration of the fixing unit shown in FIG. 1 according to a third illustrative embodiment.

FIG. 19 is a side sectional view schematically illustrating the configuration of a third illustrative embodiment of the fixing unit 6 shown in FIG. 1. The feature of the configuration of the fixing unit 6 according to this illustrative embodiment will be described in detail with reference to FIG. 19.

The fixing unit 6 includes a fixing belt 631, a press roller 632, a nip plate 633, a stay 634, and a heat source device 635.

The fixing belt 631 is an endless belt formed in a tubular shape and has a heat resistance and flexibility. The fixing belt 631 is held at a predetermined position by a guide member (not illustrated), and is supported to be rotatable around a shaft parallel with the sheet width direction.

The press roller 632 (an example of a facing member) is disposed to face the outer circumference of the fixing belt 631. The press roller 632 is a roller-type member with an elastically deformable rubber layer formed on its outer circumference, and is supported to be rotatable around a shaft parallel with the sheet width direction.

The nip plate 633 (an example of a nip member) is a plate-like member, and is accommodated in the fixing belt 631 to face the press roller 632, with the fixing belt 631 being interposed therebetween. The nip plate 633 comes into contact with the inner peripheral surface of the fixing belt 631 to elastically deform the above-described rubber layer, and is provided to cause the nip portion NP to have a predetermined width along the sheet transport direction.

The nip plate 633 has a heat radiating member 6331 and a heat radiating member support portion 6332. The heat radiating member 6331 is made of a material having thermal conductivity higher than that of the heat radiating member support portion 6332. Specifically, in this illustrative embodiment, the heat radiating member 6331 is made of aluminum (alloy) which is a metal having high thermal conductivity. The heat radiating member support portion 6332 is made of a liquid crystal polymer which is a synthetic resin material having low thermal conductivity and a high heat-resisting property.

The heat radiating member 6331 (an example of a heat transfer member) is provided at a position corresponding to a portion of the nip portion NP when seen from a side view. Specifically, the heat radiating member 6331 is provided at the upstream side of the nip portion NP in the sheet transport direction.

The stay 634 (an example of a support member) is a substantially U-shaped member (substantially reversed U-shaped or n-shaped in the drawing) which is opened toward the nip plate 633 when seen from a side sectional view, and is disposed (received) in the fixing belt 631 to support the nip plate 633. The stay 634 is made of the liquid crystal polymer which is a synthetic resin material having low thermal conductivity and a high heat-resisting property. That is, in this illustrative embodiment, the stay 634 is made of the same material as that of the heat radiating member support portion 6332 in the nip plate 633.

In this illustrative embodiment, the stay 634 is joined to the nip plate 633 to support the end portion of the nip plate 633 and form a substantially closed space therein. That is, both end portions of the stay 634 in the sheet width direction are provided with a pair of lateral plates which are perpendicular to the sheet width direction.

The heat source device 635 is disposed in the fixing belt 631 to heat the nip portion NP. Specifically, the heat source device 635 is accommodated in the substantially closed space enclosed by the nip plate 633 and the stay 634. The heat source device 635 includes an elliptical mirror 6351, a heater 6352, a heat receiving member 6353, and an intermediate heat transfer member 6354.

The elliptical mirror 6351 is a tubular member having an elliptical shape, when seen from a side sectional view, formed by bending an aluminum (alloy) plate, and is supported from the outside by the stay 634. An inner surface of the elliptical mirror 6351 is subjected to a mirror process to increase a reflectance of infrared rays (including far infrared rays) generated from the heater 6352. The elliptical mirror 6351 has two focal points (a first focal point FP1 and a second focal point FP2). In this illustrative embodiment, the first focal point FP1 is provided at the downstream side in the sheet transport direction and closer to the sheet S (sheet transport path PP in FIG. 1) with respect to the second focal point FP2, when seen from a side section view.

The heater 6352 is a heating element configured by a halogen lamp, and is configured to generate the radiant heat by electric conduction. The heater 6352 is disposed at a position corresponding to the first focal point FP1. That is, the heater 6352 is disposed such that a filament extending in the sheet width direction in the heater 6352 substantially coincides with the first focal point FP1.

The heat receiving member 6353 is disposed at a position corresponding to the second focal point FP2 to receive the radiant heat from the heater 6352. In this illustrative embodiment, the heat receiving member 6353 is a circular rod-shaped member disposed parallel with the heater 6352, and is made of aluminum (alloy) which is a metal having high thermal conductivity. That is, the heat receiving member 6353 is disposed such that its center axis substantially coincides with the second focal point FP2. Further, the heat receiving member 6353 is made of the same material as that of the heat radiating member 6331 of the nip plate 633.

The intermediate heat transfer member 6354 is a plate-like member bent, when seen from a side sectional view, to connect the heat receiving member 6353 and the heat radiating member 6331, and is provided to transfer the heat received by the heat receiving member 6353 to the heat radiating member 6331 of the nip plate 633. Specifically, in this illustrative embodiment, the intermediate heat transfer member 6354 is fixedly provided to the elliptical mirror 6351 to penetrate the elliptical mirror 6351. That is, the elliptical mirror 6351 comes into close contact with the intermediate heat transfer member 6354, so as to cover the substantially whole circumference of the heater 6352.

In this illustrative embodiment, the intermediate heat transfer member 6354 is made of aluminum (alloy) which is a metal having high thermal conductivity. That is, the intermediate heat transfer member 6354 is made of the same material as that of the heat radiating member 6331 of the nip plate 633 and the heat receiving member 6353. Further, the heat receiving member 6353, the intermediate heat transfer member 6354, and the heat radiating member 6331 of the nip plate 633 are formed integrally with each other, without having a joint portion.

In this illustrative embodiment, the intermediate heat transfer member 6354 is formed to have a thickness smaller than an outer diameter of the heat receiving member 6353. The portion of the heat receiving member 6353 which face the elliptical mirror 6351 has a blackbody surface 6355 formed by black paint.

<Functions and Effects of Third Illustrative Embodiment>

In the fixing unit 6 according to this illustrative embodiment, the radiant heat generated from the heater 6352 disposed at the first focal point FP1 is focused on the heat receiving member 6353 disposed at the second focal point FP2. The heat received by the heat receiving member 6353 is transferred to the heat radiating member 6331 positioned on a portion (upstream portion) of the nip portion NP, when seen from a side view, through the intermediate heat transfer member 6354.

After starting power to the heater 6352, the portion (upstream portion) of the nip portion NP is quickly heated to a proper temperature for toner fixation. Further, the radiant heat generated from the heater 6352 is intensively transferred to the portion (upstream portion) of the nip portion NP. Therefore, it promotes the increase in image forming speed, and further promotes the reduction in electric power and the reduction in warm-up time. Further, the portion of the nip portion NP at the downstream side from the heat transfer member 6331 in the sheet transport direction has a relatively low temperature. For this reason, it is possible to suppress a hot offset generated at the portion due to the softening or melting of the toner, thereby improving the image quality after fixing.

In particular, according to this illustrative embodiment, the elliptical mirror 6351 comes into close contact with the intermediate heat transfer member 6354, and is provided to cover the substantially whole circumference of the heater 6352. Also, the elliptical mirror 6351 and the heater 6352 are accommodated in a substantially closed space enclosed by the nip plate 633 and the stay 634. Further, the nip plate 633 is configured such that the heat radiating member 6331 having the high heat conductivity is enclosed by the heat radiating member support portion 6332 having the low heat conductivity (i.e., substantially functioning as a heat insulating material).

According to the configuration, in the substantially closed spaced enclosed by the nip plate 633 and the stay 634, the radiant heat intensively concentrated at the second focal point FP2 is intensively transferred to the heat radiant member 6331 provided at the position corresponding to a portion of the nip portion NP, when seen from a side view, through the intermediate heat transfer member 6354. Thus, the position of the nip portion NP corresponding to the heat radiating member 6331 is intensively heated. For this reason, the toner carried on the sheet S is intensively heated in a short time, while the heat transfer to the sheet S is suppressed as possible. Therefore, according to the configuration, since good fixing strength and thermal efficiency (fixing efficiency) can be obtained, it promotes the increase in image forming speed, and further promotes the reduction in an electric power and the reduction in warm-up time.

In the fixing unit 6 of this illustrative embodiment, the radiant heat generated from the heater 6352 is effectively collected by the heat receiving member 6353, and then is intensively transferred to a portion of the nip portion NP when seen form a side view. Therefore, the fixing unit 6 of this illustrative embodiment further promotes the reduction in an electric power and the reduction in warm-up time.

<Modifications of Third Illustrative Embodiment>

Specific modified examples (modifications) of the third illustrative embodiment will be described. Of course, the modification to the illustrative embodiment is not limited to the following examples.

In the following description of the modifications, in principle, the same symbols as used in the above-described illustrative embodiment are used for components having the same configurations and functions explained in the above-described illustrative embodiment. And, for descriptions of such components, the descriptions in the above-described illustrative embodiment are quoted as long as they do not technically contradict. Obviously, the scope of the present invention is not limited by the modifications below. In addition, a plurality of modifications can be combined, appropriately, as long as they do not technically contradict. Furthermore, a part of the above-described illustrative embodiment and a part of the modification can be appropriately combined.

Referring to FIG. 19, the heat radiating member 6331, the heat receiving member 6353, and the intermediate heat transfer member 6354 may be made of a metal having high thermal conductivity, such as aluminum (alloy) or copper. Further, the heat radiating member 6331, the heat receiving member 6353, and the intermediate heat transfer member 6354 may be made of different material. In addition, the heat radiating member 6331 and the intermediate heat transfer member 6354 may be separate members but in contact with each other.

The heat radiating member support portion 6332 may be made of a metal having low thermal conductivity, such as stainless steel, ceramics, or a synthetic resin material (liquid crystal polymer, polyimide, polyamide imide, or the like) having the low thermally conductivity and the high heat-resisting property. Further the heat radiating member support portion 6332 may be formed with the stay 634.

Further, the center of the heat receiving member 6353, when seen from a side sectional view, and the second focal point FP2 may not completely coincide with each other. That is, it is preferable that the second focal point FP2 exists inside the outline of the heat receiving member 6353, when seen from a side sectional view. A relationship between the heater 6352 and the first focal point PF1 is similar.

Figure 20:
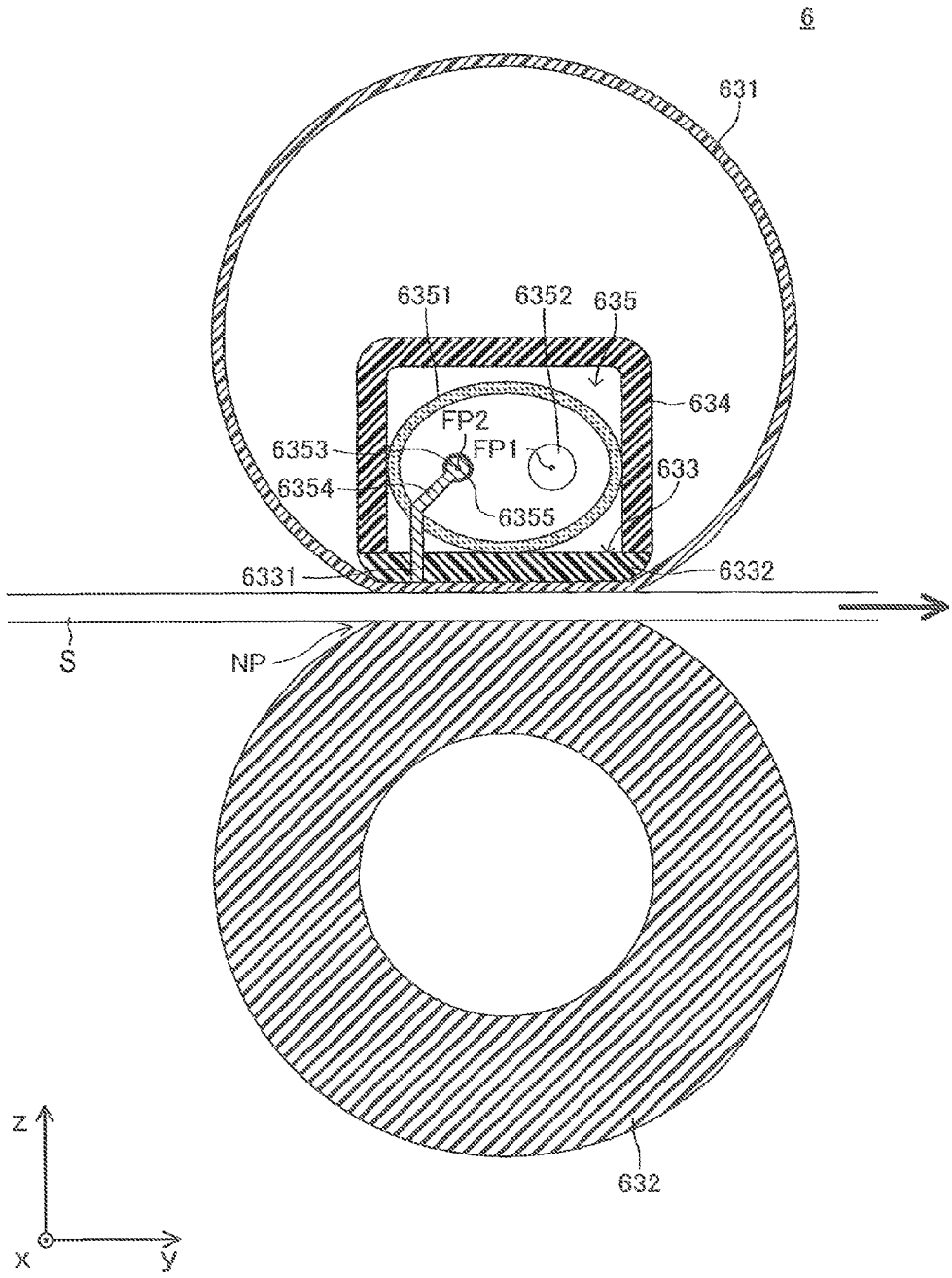
FIG. 20 is a side sectional view illustrating a modification of the fixing unit shown in FIG. 19.

FIG. 20 is a side sectional view illustrating a modification of the fixing unit 6 shown in FIG. 19. As illustrated in FIG. 20, the first focal point FP1 and the second focal point FP2 may be provided at a substantially equal distance from the sheet S (the sheet transport path PP in FIG. 1), when seen from a side sectional view. With the configuration, it is possible to downsize the heat source device 635 or the stay 634.

The shape of the heat receiving member 6353 is not limited to the specific example illustrated in the above-described illustrative embodiment. That is, the shape of the heat receiving member 6353 when seen from a side sectional view is not limited to the circular shape. Further, the outer diameter of the heat receiving member 6353 may be substantially identical to the thickness of the intermediate heat transfer member 6354.

Figure 21:
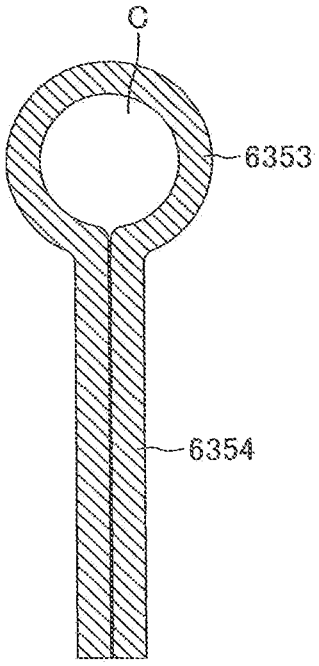
FIG. 21 is a side sectional view illustrating a modification of the heat receiving member shown in FIGS. 19 and 20.

FIG. 21 is a side sectional view illustrating a modification of the heat receiving member 6353 shown in FIGS. 19 and 20. As illustrated in FIG. 21, the heat receiving member 6353 may be formed in a substantially cylindrical shape. That is, a cavity C may be formed near a center shaft inside the heat receiving member 6353. Therefore, since the heat capacity of the heat receiving member 6353 is decreased, the raised speed of the temperature is improved. For example, as illustrated in FIG. 21, the heat receiving member 6353 with the cavity C therein is formed integrally with the intermediate heat transfer member 6354 by bending a sheet of thin plate.

Figure 22:
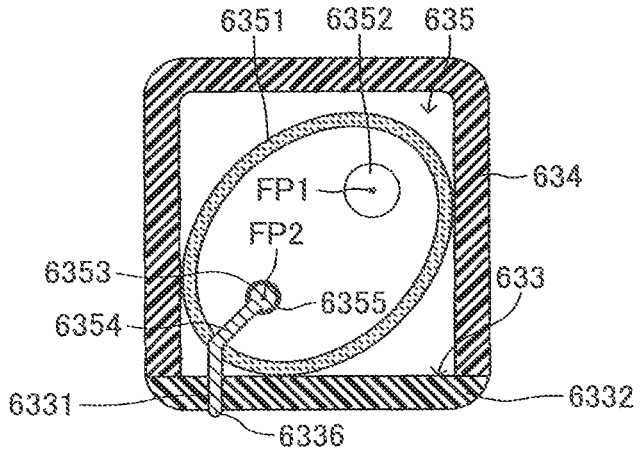
FIG. 22 is a side sectional view illustrating a modification of the configuration of the nip plate shown in FIG. 19.
Figure 22:
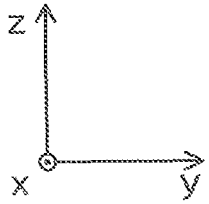

FIG. 22 is a side sectional view illustrating a modification of the configuration of the nip plate 633 shown in FIG. 19. As illustrated in FIG. 19, the heat insulating member 6331 may have a projection 6336. The projection 6336 is provided to protrude toward the nip portion NP (see FIG. 19) further than the heat radiating member support portion 6332. With the configuration, the contact of the heat radiating member 6331, the fixing belt 631, and the sheet S is improved at the position corresponding to the projection 6336 of the nip portion NP (see FIG. 19), thereby further improving the heat transfer efficiency at the position of the nip portion NP by the heat radiating member 6331.

Fourth Illustrative Embodiment

<Detailed Configuration of Fixing Unit>

Figure 23:
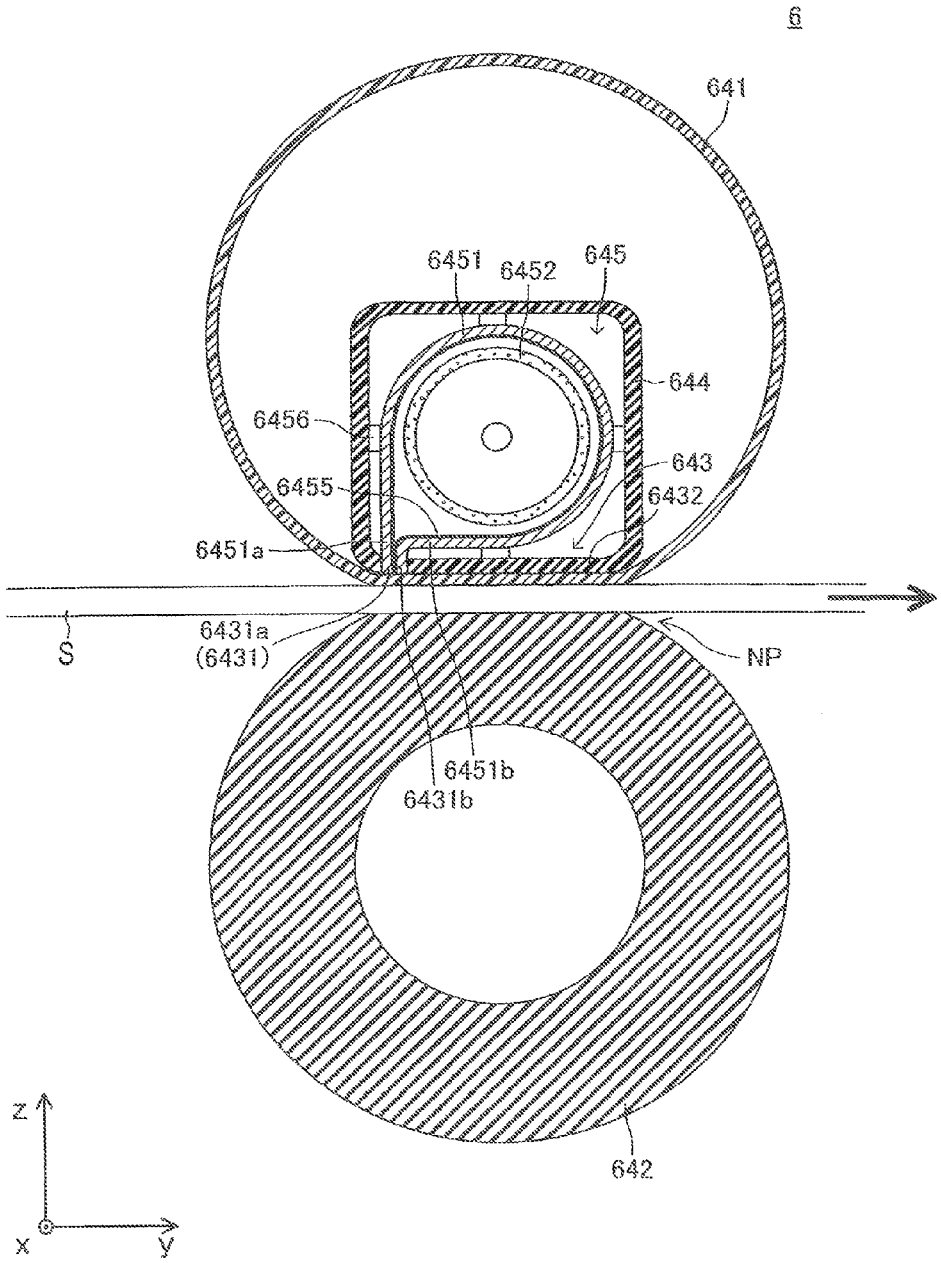
FIG. 23 is a side sectional view schematically illustrating the configuration of the fixing unit shown in FIG. 1 according to a fourth illustrative embodiment.

FIG. 23 is a side sectional view schematically illustrating the configuration of a fourth illustrative embodiment of the fixing unit 6 shown in FIG. 1. The feature of the configuration of the fixing unit 6 according to this illustrative embodiment will be described in detail with reference to FIG. 23.

The fixing unit 6 includes a fixing belt 641, a press roller 642, a nip plate 643, a stay 644, and a heat source device 645.

The fixing belt 641 is an endless belt formed in a tubular shape and has a heat resistance and flexibility. The fixing belt 641 is held at a predetermined position by a guide member (not illustrated), and is supported to be rotatable around a shaft parallel with the sheet width direction.

The press roller 642 (an example of a facing member) is disposed to face the outer circumference of the fixing belt 641. The press roller 642 is a roller-type member with an elastically deformable rubber layer formed on its outer circumference, and is supported to be rotatable around a shaft parallel with the sheet width direction.

The nip plate 643 (an example of a nip member) is a plate-like member, and is accommodated in the fixing belt 641 to face the press roller 642, with the fixing belt 641 being interposed therebetween. The nip plate 643 comes into contact with the inner peripheral surface of the fixing belt 641 to elastically deform the above-described rubber layer, and is provided to cause the nip portion NP to have a predetermined width along the sheet transport direction.

The nip plate 643 has a heat transfer member 6431 (6431*a* and 6431*b*) and a heat insulating member 6432. That is, in this illustrative embodiment, the heat transfer member 6431 is separated into a heat transfer member 6431*a* and a heat transfer member 6431*b* in the sheet transport direction.

The heat transfer members 6431*a* and 6431*b* are made of a material having thermal conductivity higher than that of the heat insulating member 6432. Specifically, in this illustrative embodiment, the heat transfer members 6431*a* and 6431*b* are made of aluminum (alloy) which is a metal having high thermal conductivity. The heat insulating member 6432 is made of a synthetic resin material having low thermal conductivity and a high heat-resisting property.

The heat transfer members 6431*a* and 6431*b* are provided at a position corresponding to a portion of the nip portion NP when seen from a side view (seen from a side sectional view), so as to transfer the heat from the heat source device 645 to the nip portion NP. Specifically, the heat transfer members 6431*a* and 6431*b* are provided at the upstream side of the nip portion NP in the sheet transport direction.

In this illustrative embodiment, the heat transfer members 6431*a* and 6431*b* are portions having a rod shape or a long plate shape, with its longitudinal direction being in the sheet width direction, and are arranged in parallel with each other. The heat transfer member 6431*a* is disposed adjacent to the heat transfer member 6431*b* at the upstream side from the heat transfer member 6431*b* in the sheet transport direction. Specifically, the heat transfer members 6431*a* and 6431*b* are provided to be in close contact with each other in the sheet transport direction.

The heat insulating member 6432 is a part of the nip plate 643 except for the heat transfer members 6431*a* and 6431*b*. The heat insulating member 6432 is provided at the portions at the upstream and downstream sides with respect to the heat transfer members 6431*a* and 6431*b* in the sheet transport direction, and at the portions adjacent to both end portions of the heat transfer members 6431*a* and 6431*b* in the sheet width direction.

The stay 644 is a substantially reversed U-shaped or n-shaped member when seen from a side sectional view, and is disposed (received) in the fixing belt 641 to support the nip plate 643. The stay 644 is made of a synthetic resin material having low thermal conductivity and a high heat-resisting property. Specifically, in this illustrative embodiment, the stay 644 is made of the same material as that of the heat insulating member 6432 in the nip plate 643.

The heat source device 645 is disposed in the fixing belt 641 to heat the nip portion NP. Specifically, the heat source device 645 is accommodated in the substantially closed space enclosed by the nip plate 643 and the stay 644. The heat source device 645 includes a heat collecting member 6451 and a heater 6452.

The heat collecting member 6451 is a tubular member, when seen from a side sectional view, formed by bending an aluminum (alloy) plate, and is provided to surround the circumference of the heater 6452 and thus accommodates the heater 6152 therein. In this illustrative embodiment, a gap of a predetermined interval is formed between an inner surface of the heat collecting member 6451 facing the heater 6452, and the heater 6452. The heat collecting member 6451 is connected to the heat transfer members 6431*a* and 6431*b* to transfer the heat received from the heater 6452 to the heat transfer members 6431*a* and 6431*b* in the nip plate 643.

In this illustrative embodiment, the heat collecting member 6451 is made of the same material as that of the heat transfer members 6431*a* and 6431*b* of the nip plate 643, and is formed integrally with the heat transfer members 6431*a* and 6431*b*. Specifically, one end portion 6451*a* of the heat collecting member 6451 is formed integrally with the heat transfer member 6431*a*, without having a joint portion. The other end portion 6451*b* of the heat collecting member 6451 is formed integrally with the heat transfer member 6431*b*, without having a joint portion.

The heater 6452 is a heating element configured by a halogen lamp, and is configured to generate the radiant heat by electric conduction. Further, in this illustrative embodiment, the heat collecting member 6451 has a blackbody surface 6455 formed by black paint on its inner surface facing the heater 6452.

The inner surface of the stay 644 is provided with a plurality of heat collecting member support portions 6456. The heat collecting member support portions 6456 are provided to project toward the heat collecting member 6451, as projecting members which abut against an outer surface of the heat collecting member 6451 to support the outside of the heat collecting member 6451. That is, the heat collecting member 6451 is supported in the stay 644 by the plurality of heat collecting member support portions 6456. In this illustrative embodiment, four heat collecting member support portions 6456 of a substantially rod shape, with its longitudinal direction being in the sheet width direction, are disposed to enclose all sides of the heat collecting member 6451 when seen from a side sectional view.

The heat collecting member support portions 6456 are made of a material having a heat-resistant property (i.e., the heat conductivity is low). Specifically, the heat collecting member support portions 6456 are made of a synthetic resin material having low thermal conductivity and a high heat-resisting property.

<Functions and Effects of Fourth Illustrative Embodiment>

In the fixing unit 6 according to this illustrative embodiment, the radiant heat generated from the heater 6452 is received by the heat collecting member 6451. The heat received by the heat collecting member 6451 is radiated toward the nip portion NP through heat transfer member 6431 (6431*a* and 6431*b*). Accordingly, the nip portion NP is heated.

In the configuration of this illustrative embodiment, the heat transfer member 6431 is provided at the position corresponding to a portion of the nip portion NP (i.e., a portion of the nip portion NP in the sheet transport direction) when seen from a side sectional view. For this reason, the heated portion of the nip portion NP (i.e., a portion of the nip portion NP in the sheet transport direction) is not the whole portion of the nip portion NP, but is concentrated on a relatively narrow region of the portion. Accordingly, the toner carried on the sheet S is intensively heated in a short time, while the heat transfer to the sheet S is suppressed as possible.

In particular, in the configuration of this illustrative embodiment, since the heat transfer member 6431 is provided at a portion of the upstream side of the nip portion NP when seen from a side sectional view, the heat intensively flows in such a portion. Then, the toner is softened well at the upstream side than the center portion of the nip portion NP, in which the maximum pressure is generated, in the sheet transport direction. Further, since the toner is pressed against the sheet S in the sufficiently softened state, the toner image is reliably fixed on the sheet S. Therefore, the configuration of this illustrative embodiment can obtain the good fixing strength and fixing efficiency, thereby further reducing an electric power and shortening a warm-up time.

Further, in the configuration of this illustrative embodiment, the portion of the nip portion NP at the downstream side from the heat transfer member 6431 in the sheet transport direction has a relatively low temperature. For this reason, it is possible to suppress a hot offset generated at the portion due to the softening or melting of the toner, thereby improving the image quality after fixing.

In the configuration of this illustrative embodiment, the heat transfer members 6431*a* and 6431*b* for heating the nip portion NP, and the heat collecting member 6451 enclosing the heater 6452 to receive the radiant heat from the heater 6452 are formed integrally with each other (i.e., as substantially single member). For this reason, the configuration can obtain the good thermal efficiency, and simplify the construction thereof.

<Modifications of Fourth Illustrative Embodiment>

Specific modified examples (modifications) of the third illustrative embodiment will be described. Of course, the modification to the illustrative embodiment is not limited to the following examples.

In the following description of the modifications, in principle, the same symbols as used in the above-described illustrative embodiment are used for components having the same configurations and functions explained in the above-described illustrative embodiment. And, for descriptions of such components, the descriptions in the above-described illustrative embodiment are quoted as long as they do not technically contradict. Obviously, the scope of the present invention is not limited by the modifications below. In addition, a plurality of modifications can be combined, appropriately, as long as they do not technically contradict. Furthermore, a part of the above-described illustrative embodiment and a part of the modification can be appropriately combined.

The outer surface of the heat collecting member 6451 may be subjected to a mirror process. Therefore, a radiation amount outward (i.e., a space between the heat collecting member 6451 and the stay 644) from the heat collecting member 6451 becomes small, thereby improving the thermal efficiency.

The stay 644 and the heat collecting member support portion 6456 may be made of the same material. In this instance, the stay 644 and the heat collecting member support portion 6456 may be formed integrally with each other. Alternatively, the stay 644 and the heat collecting member support portion 6456 may be made of different material.

Figure 24:
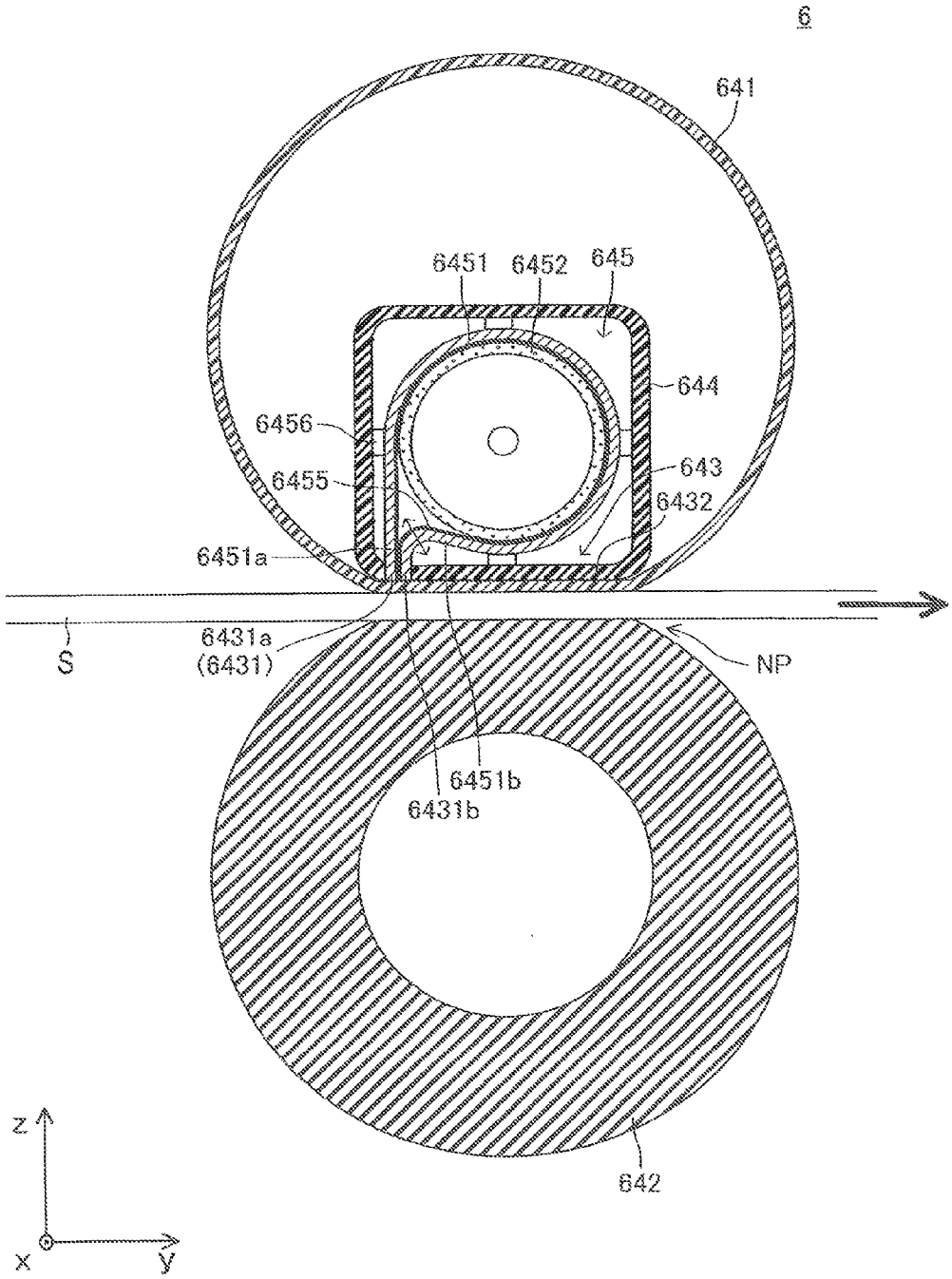
FIG. 24 is a side sectional view illustrating a modification of the fixing unit shown in FIG. 23.

FIG. 24 is a side sectional view illustrating a modification of the fixing unit 6 shown in FIG. 23. As illustrated in FIG. 24, the blackbody surface 6155 can be omitted. Further, the inner surface of the heat collecting member 6451 facing the heater 6452 may be brought into contact with the heater 6452. The end portion 6451*b* of the heat collecting member 6451 may be sagged such that it can be deformed corresponding to expansion and contraction of the heat collecting member 6451 due to the variation in temperature (see the arrow in the drawing).

Figure 25:
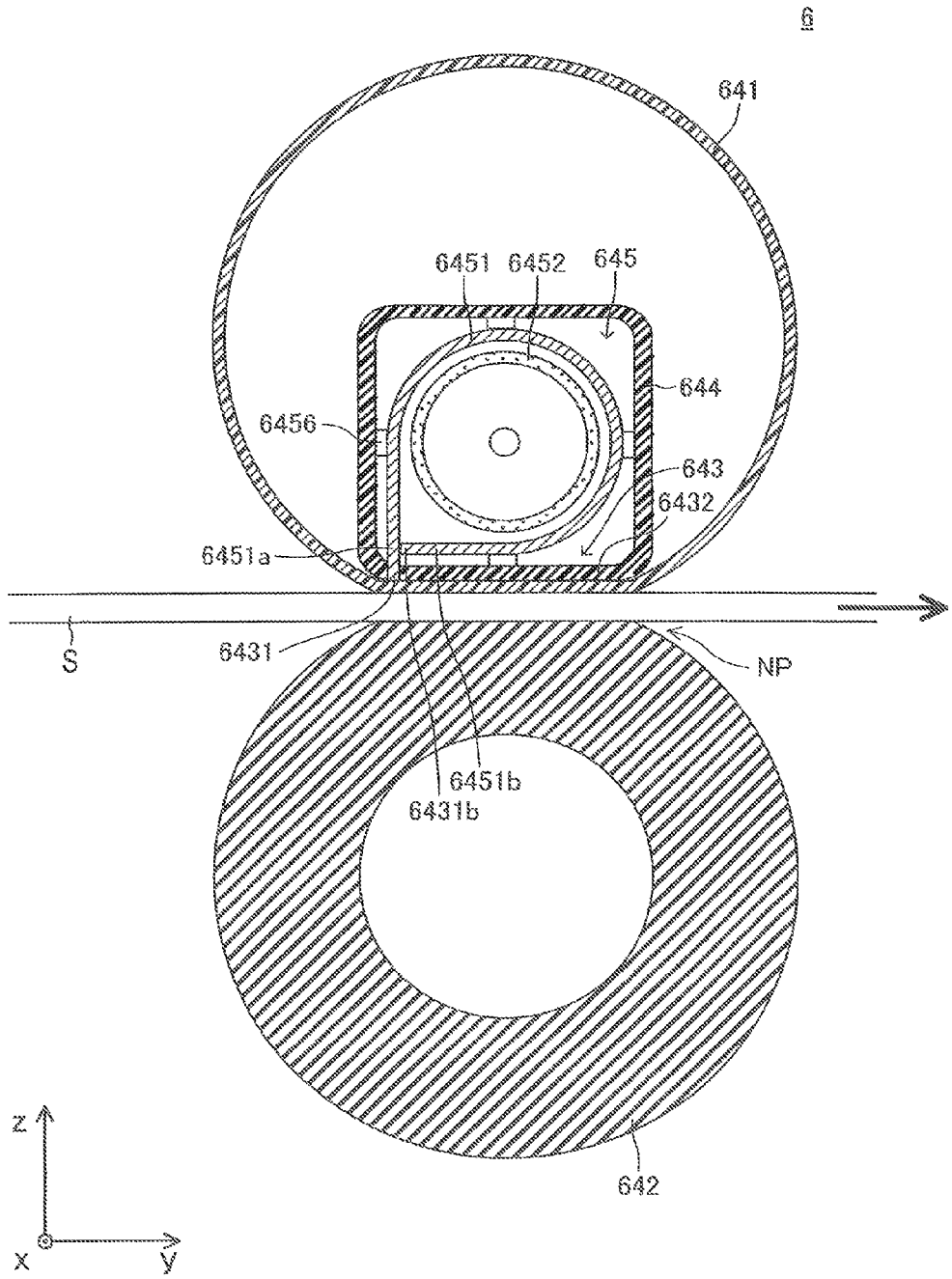
FIG. 25 is a side sectional view illustrating another modification of the fixing unit shown in FIG. 23.

FIG. 25 is a side sectional view illustrating another modification of the fixing unit 6 shown in FIG. 23. As illustrated in FIG. 25, one end portion (end portion 6451*b* in FIG. 25) of the heat collecting member 6451 may be provided to be in contact with the other end portion (end portion 6451*a* in FIG. 25). In this instance, only one heat transfer member 6431 which is formed integrally with the other end portion is provided. In the configuration, the heat generated from the heater 6452 is applied to the nip portion NP in the state in which the heat is gathered in one heat transfer member 6431.

Figure 26:
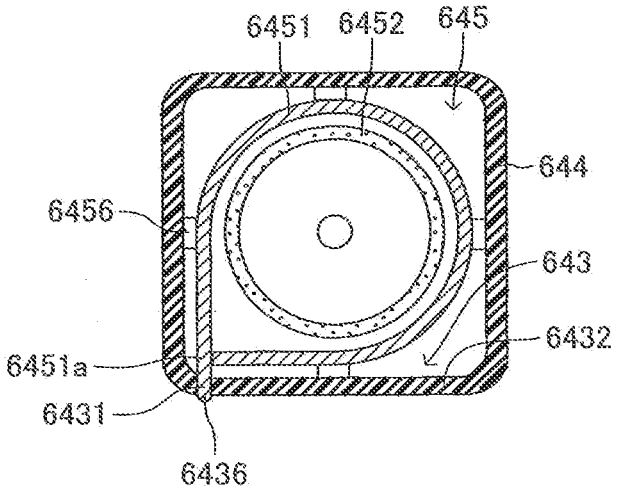
FIG. 26 is a side sectional view illustrating a modification of the nip plate shown in FIG. 23.
Figure 26:
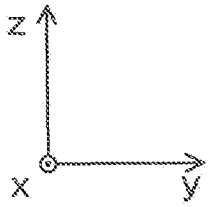
Figure 27:
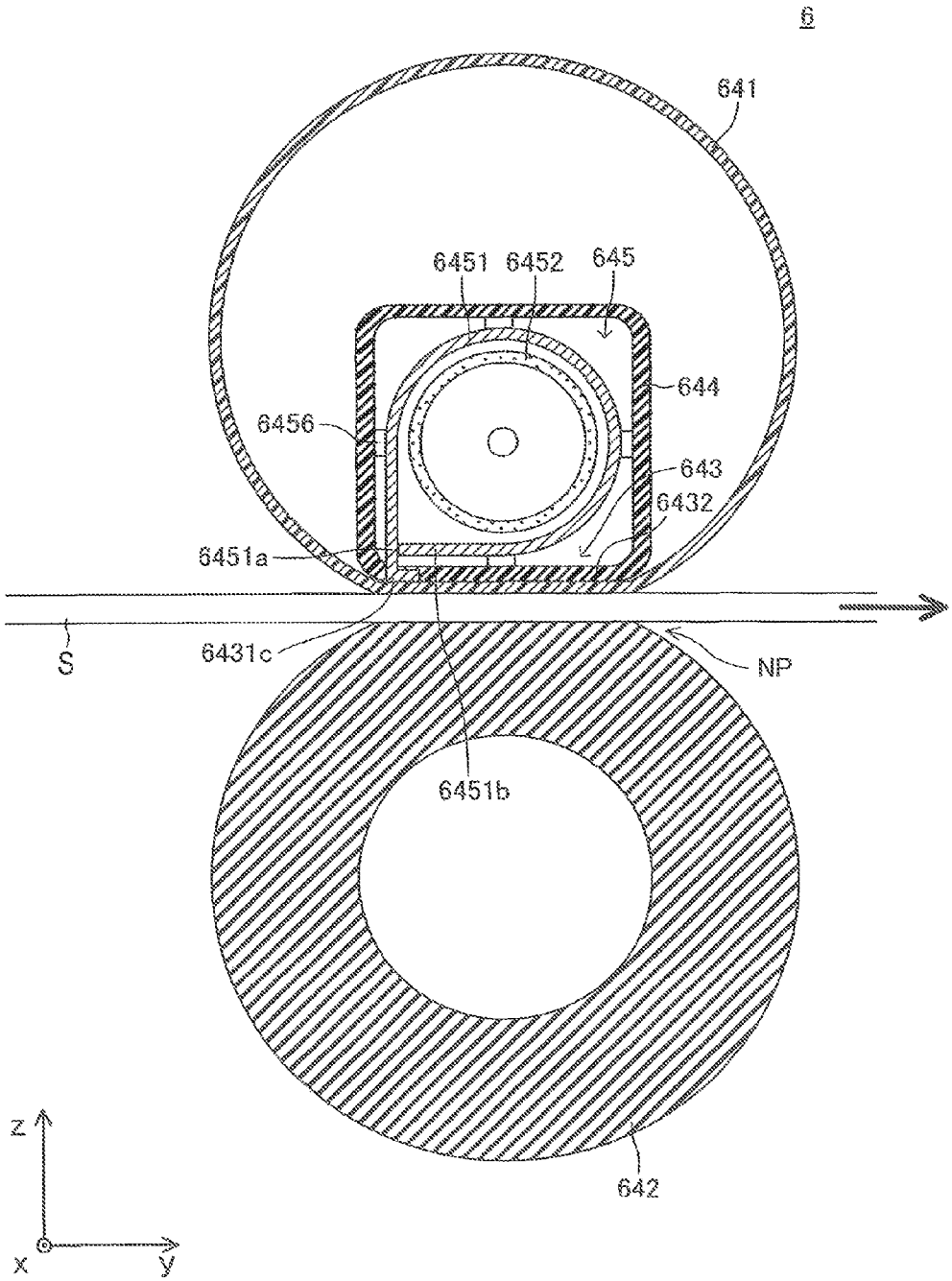
FIG. 27 is a side sectional view illustrating a further modification of the fixing unit shown in FIG. 23.

FIG. 26 is a side sectional view illustrating a modification of the nip plate 643 shown in FIG. 23. As illustrated in FIG. 24, the heat transfer member 6431 may be provided with a projection 6436. The projection 6436 is provided to protrude toward the nip portion NP (see FIG. 23) further than the heat insulating member 6432. With the configuration, the contact of the heat transfer member 6431, the fixing belt 641, and the sheet S is improved at the position corresponding to the projection 6436 of the nip portion NP (see FIG. 23), thereby further improving the heat transfer efficiency at the position of the nip portion NP by the heat transfer member 6431.

The heat source device of the present invention is not limited to one utilizing a halogen lamp. Specifically, for example, a planar heater is used as the heater 6452. In this instance, the heater 6452 which is the planar heater is provided to be brought into close contact with the heat collecting member 6451. In this instance, the blackbody surface 6455 is not necessary, as illustrated in FIG. 24.

<Modifications Common to Respective Illustrative Embodiments>

While the present invention has been shown and described with reference to certain illustrative embodiments thereof, it will be understood by those skilled in the art that various changes in form and details may be made therein without departing from the spirit and scope of the invention as defined by the appended claims.

In the following description of the modifications, in principle, the same symbols as used in the above-described illustrative embodiment are used for components having the same configurations and functions explained in the above-described illustrative embodiment. And, for descriptions of such components, the descriptions in the above-described illustrative embodiment are quoted as long as they do not technically contradict.

Obviously, the scope of the present invention is not limited by the modifications below. In addition, a plurality of modifications can be combined, appropriately, as long as they do not technically contradict. Furthermore, a part of the above-described illustrative embodiment and a part of the modification can be appropriately combined.

In the above illustrative embodiments, the present invention is applied to the laser printer capable of forming a monochromatic image. However, the present invention is not limited thereto. For example, the present invention can be appropriately applied to electro-photographic image forming apparatuses, such as a multi-color laser printer and a monochromatic and color copying machine. In this instance, the shape of the photosensitive may not be a drum type, like the above-described illustrative embodiment. For example, it may be formed in a shape of planar plate or an endless belt. An exposure method (analog or digital) is not specifically limited.

Further, in the above illustrative embodiments, non-magnetic single-component development is used. However, the present invention is not limited thereto.

Accordingly, the present invention can be appropriately applied to an image forming apparatus of magnetic two-component development type. Further, the present invention can also be appropriately applied to an image forming apparatus of a type (e.g., an image forming type directly controlling scattering or adhesion of developer or charges by a multi-stylus electrode or an aperture electrode) which does not use a photosensitive body.

Referring to FIG. 1, in the process cartridge 4, the process case 41 may be not detachable from the toner case 45. Further, the toner case 45 only may be freely detachable from the body frame 21.

The facing member in the above illustrative embodiment is not limited to the roller type. For example, a plane-type member or belt-type member may be used as the facing member.

The stay may be formed in a top-opened shape (that is, a substantially rectangular shape when seen from a plan view).

The blackbody surface is not limited to the black paint. For example, an organic or inorganic infrared absorption film or concave-convex shape (groove shape) may be formed as the blackbody surface.

What is claimed is:

1. A fixing device comprising:

a fixing belt which is an endless belt;

a facing member provided to face an outer surface of the fixing belt;

a nip member configured to contact an inner surface of the fixing belt to form a nip portion where the fixing belt and the facing member are in contact with each other; and a heat source device configured to heat the nip portion inside the fixing belt, wherein the nip member includes:

a heat transfer member which is provided at a position corresponding to a portion of the nip portion, when seen from a side view, to transfer heat from the heat source device to the nip portion; and a heat insulating member which is a portion of the nip member except for the heat transfer member, and is made of a material having thermal conductivity lower than that of the heat transfer member, and wherein the heat transfer member has a thickness in a facing direction of the nip member and the facing member smaller than that of the heat insulating member.

2. The fixing device according to claim 1, wherein the nip member has a planar shape.

3. The fixing device according to claim 1, wherein the heat source device includes a heater for generating a radiant heat, and wherein the nip member is provided such that at least the heat transfer member faces the heater.

4. The fixing device according to claim 3, wherein the heat source device further includes a support member which is formed in a substantially U-shape opened toward the nip member when seen from a side sectional view, and wherein the support member closely contacts the nip member and supports the nip member while accommodating the heater in a space enclosed by the support member and the nip member.

5. The fixing device according to claim 1, wherein the heat transfer member is provided at an upstream side of the nip portion in a transport direction of a recording medium.

6. The fixing device according to claim 1, wherein the heat insulating member is provided at a position corresponding to a portion of the nip portion when seen from the side view.

7. A fixing device comprising:

a fixing belt which is an endless belt;

a facing member provided to face an outer surface of the fixing belt;

a nip member configured to contact an inner surface of the fixing belt to form a nip portion where the fixing belt and the facing member are in contact with each other; and a heat source device configured to heat the nip portion inside the fixing belt, wherein the nip member includes:

a heat transfer member which is provided at a position corresponding to a portion of the nip portion, when seen from a side view, to transfer heat from the heat source device to the nip portion; and a heat insulating member which is a portion of the nip member except for the heat transfer member, and is made of a material having thermal conductivity lower than that of the heat transfer member, wherein the heat transfer member includes:

a heat receiving surface which is a surface facing the heat source device to receive the heat from the heat source device; and a heat providing surface which is a surface facing the nip portion and in contact with the inner surface of the fixing belt to provide the heat to the nip portion, wherein the heat providing surface has an area smaller than that of the heat receiving surface, and wherein a gap is formed between the heat transfer member and the heat insulating member.

8. The fixing device according to claim 7, wherein the nip member has a planar shape.

9. The fixing device according to claim 7, wherein the heat source device includes a heater for generating a radiant heat, and wherein the nip member is provided such that at least the heat transfer member faces the heater.

10. The fixing device according to claim 9, wherein the heat source device further includes a support member which is formed in a substantially U-shape opened toward the nip member when seen from a side sectional view, and wherein the support member closely contacts the nip member and supports the nip member while accommodating the heater in a space enclosed by the support member and the nip member.

11. The fixing device according to claim 7, wherein the heat transfer member is provided at an upstream side of the nip portion in a transport direction of a recording medium.

12. The fixing device according to claim 7, wherein the heat insulating member is provided at a position corresponding to a portion of the nip portion when seen from the side view.

13. A fixing device comprising:

a fixing belt which is an endless belt;

a facing member provided to face an outer surface of the fixing belt;

a nip member configured to contact an inner surface of the fixing belt to form a nip portion where the fixing belt and the facing member are in contact with each other; and a heat source device configured to heat the nip portion inside the fixing belt, wherein the nip member includes:

a heat transfer member which is provided at a position corresponding to a portion of the nip portion, when seen from a side view, to transfer heat from the heat source device to the nip portion; and a heat insulating member which is a portion of the nip member except for the heat transfer member, and is made of a material having thermal conductivity lower than that of the heat transfer member, and wherein the heat transfer member projects toward the nip portion further than the heat insulating member.

14. The fixing device according to claim 13, wherein the heat transfer member includes:

a heat receiving surface which is a surface facing the heat source device to receive the heat from the heat source device; and a heat providing surface which is a surface facing the nip portion and in contact with the inner surface of the fixing belt to provide the heat toward the nip portion, and wherein the heat providing surface has an area smaller than that of the heat receiving surface.

15. The fixing device according to claim 14, wherein the heat transfer member has a trapezoidal shape when seen from a side sectional view.

16. The fixing device according to claim 13, wherein the nip member has a planar shape.

17. The fixing device according to claim 13, wherein the heat source device includes a heater for generating a radiant heat, and wherein the nip member is provided such that at least the heat transfer member faces the heater.

18. The fixing device according to claim 17, wherein the heat source device further includes a support member which is formed in a substantially U-shape opened toward the nip member when seen from a side sectional view, and wherein the support member closely contacts the nip member and supports the nip member while accommodating the heater in a space enclosed by the support member and the nip member.

19. The fixing device according to claim 13, wherein the heat transfer member is provided at an upstream side of the nip portion in a transport direction of a recording medium.

20. The fixing device according to claim 13, wherein the heat insulating member is provided at a position corresponding to a portion of the nip portion when seen from the side view.

* * * * *